US006370087B1

(12) United States Patent
Akahane et al.

(10) Patent No.: US 6,370,087 B1
(45) Date of Patent: Apr. 9, 2002

(54) TIME MEASUREMENT DEVICE AND TIME MEASUREMENT METHOD

(75) Inventors: Hidehiro Akahane, Tatsuno-machi; Kenichi Okuhara, Kiso-mura; Akihiko Maruyama, Suwa; Nobuhiro Koike, Chino, all of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/446,377

(22) PCT Filed: Apr. 21, 1999

(86) PCT No.: PCT/JP99/02134

§ 371 Date: Feb. 29, 2000

§ 102(e) Date: Feb. 29, 2000

(87) PCT Pub. No.: WO99/54791

PCT Pub. Date: Oct. 28, 1999

(30) Foreign Application Priority Data

Apr. 21, 1998 (JP) ..... 10-111066

(51) Int. Cl.[7] ..... G04B 19/04
(52) U.S. Cl. ..... 368/110; 368/80; 368/112
(58) Field of Search ..... 368/80, 110–113, 368/72–74, 157, 160

(56) References Cited

U.S. PATENT DOCUMENTS 5,740,132 A 4/1998 Oshima et al.
5,959,941 A * 9/1999 Murakami et al. ..... 368/80

FOREIGN PATENT DOCUMENTS

| | | |
|---|---|---|
| JP | 48-25156 | 7/1973 |
| JP | 50-61890 | 10/1973 |
| JP | 49-123366 | 11/1974 |
| JP | 50-9464 | 1/1975 |
| JP | 55-172895 | 5/1979 |
| JP | 56-2583 | 1/1981 |
| JP | 56-108990 | 8/1981 |
| JP | 58-196481 | 11/1983 |
| JP | 59-13973 | 1/1984 |
| JP | 62-47575 | 3/1987 |
| JP | 62-69190 | 3/1987 |
| JP | 5-80165 | 4/1993 |
| JP | 5-215868 | 8/1993 |
| JP | 6-265646 | 9/1994 |
| JP | 7-78543 | 8/1995 |
| JP | 7-306275 | 11/1995 |
| JP | 7-333364 | 12/1995 |
| JP | 9-101380 | 4/1997 |
| JP | 9-274526 | 10/1997 |

* cited by examiner

*Primary Examiner*—Bernard Roskoski
(74) *Attorney, Agent, or Firm*—Mark P. Watson; Michael T. Gabrik

(57) ABSTRACT

In a time measurement device (1000) having, at least, both a function of measuring standard time and a function of measuring any elapsed time, when a predetermined amount of time passes from a temporary suspension of a watch hand in position in the middle of the measurement of the elapsed time, the suspension of the watch hand is automatically released and the watch hand is driven to a watch hand position indicating the elapsed time. Provided thereby is the time measurement device which automatically releases the temporary suspension state in time measurement after the predetermined amount of time, thereby shortening the temporary suspension time and reducing power consumed to drive the watch hand to an originally expected watch hand position at the release of the temporary suspension.

18 Claims, 23 Drawing Sheets

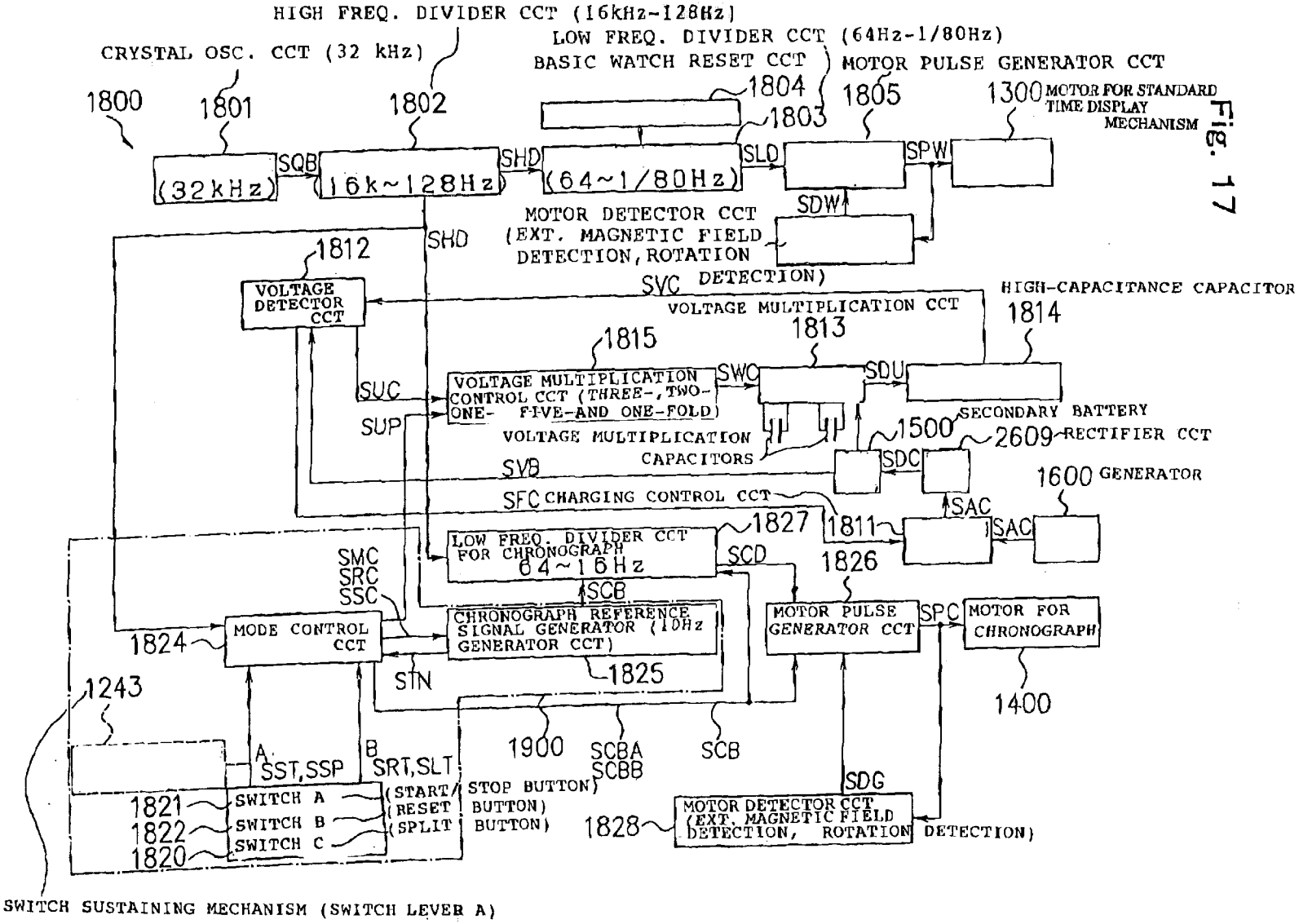
Fig. 17
HIGH FREQ. DIVIDER CCT (16kHz-128Hz)
LOW FREQ. DIVIDER CCT (64Hz-1/80Hz)
BASIC WATCH RESET CCT
MOTOR PULSE GENERATOR CCT
CRYSTAL OSC. CCT (32 kHz)
1800
1801
(32kHz)
SQB
1802
16k~128Hz
SHD
1803
1804
SLD
(64~1/80Hz)
1805
SPW
1300
MOTOR FOR STANDARD TIME DISPLAY MECHANISM
SDW
MOTOR DETECTOR CCT (EXT. MAGNETIC FIELD DETECTION, ROTATION DETECTION)
SVC
VOLTAGE MULTIPLICATION CCT
1812
VOLTAGE DETECTOR CCT
SUC
SUP
1813
1814
HIGH-CAPACITANCE CAPACITOR
SDU
SWO
1815
VOLTAGE MULTIPLICATION CONTROL CCT (THREE-, TWO-, ONE- FIVE-AND ONE-FOLD)
SVB
VOLTAGE MULTIPLICATION CAPACITORS
2609
SECONDARY BATTERY
1500
SDC
SFC
CHARGING CONTROL CCT
1600
GENERATOR
SAC
1811
1827
SCD
LOW FREQ. DIVIDER CCT FOR CHRONOGRAPH 64~16Hz
SCB
CHRONOGRAPH REFERENCE SIGNAL GENERATOR CCT (10Hz)
1825
1826
MOTOR PULSE GENERATOR CCT
SPC
MOTOR FOR CHRONOGRAPH
1400
SDG
MOTOR DETECTOR CCT (EXT. MAGNETIC FIELD DETECTION, ROTATION DETECTION)
1828
SCBA
SCBB
1900
STN
SMC
SRC
SSC
MODE CONTROL CCT
1824
B
SRT,SLT
A
SST,SSP
START/RESET BUTTON
STOP BUTTON
SPLIT BUTTON
SWITCH A
SWITCH B
SWITCH C
1821
1822
1820
1243
SWITCH SUSTAINING MECHANISM (SWITCH LEVER A)

TIME MEASUREMENT DEVICE AND TIME MEASUREMENT METHOD

BACKGROUND OF THE INVENTION

1. Technical Field

The present invention relates to a multi-function time measurement device having hands and a time measurement method.

2. Background Art

Conventionally available as a multi-function time measurement device having hands is an electronic watch having an analog indicator chronograph function, for example.

Such an electronic watch has, for chronograph purposes, a chronograph hour hand, a chronograph minute hand, and a chronograph second hand, starts time measurement at the pressing of a start/stop button, causing the chronograph hour hand, the chronograph minute hand, and the chronograph second hand to turn. When the start/stop button is pressed again, the electronic watch stops time measurement, thereby stopping the chronograph hour hand, the chronograph minute hand, and the chronograph second hand and indicating a measured time. With a reset button on the electronic watch pressed, the measured time is reset, and the chronograph hour hand, the chronograph minute hand, and the chronograph second hand are reset to zero positions (hereinafter referred to as zero reset).

Such an electronic watch has a function called split function that works as follows. When a split switch is pressed in the middle of time measurement, such an electronic watch stops the chronograph hour hand, the chronograph minute hand, and the chronograph second hand while continuing time measurement. When the split button is pressed again, the electronic watch rapidly drives the chronograph hour hand, the chronograph minute hand, and the chronograph second hand to compensate for the corresponding measurement time, and then allows them to turn in a standard speed thereafter. With this function, a user visually and accurately recognizes the measurement times at a plurality of points of time, and may record a measured time, for example.

Besides such a function, the electronic watch has a function of automatically stopping the chronograph hour hand, the chronograph minute hand, and the chronograph second hand at a maximum measurement time, for example, at a watch hand start position for the time measurement. With this function, no power is consumed needlessly even if the user forgets to press the start/stop button to stop the time measurement.

In such an electronic watch, the user may visually recognize the time indicated by temporarily stopping the time measurement with the split function after the start of the time measurement. The user may forget to release the temporary stop state thereafter. The user may notice it later, and may release the temporary stop. The electronic watch tries to rapidly drive the hands to their originally expected positions to compensate for a long temporary stop, thereby leaving the hands continuously turning for a relatively long duration of time. In the electronic watch, the power consumed in the form of motor pulses for rapidly driving the hands to their originally expected positions is greater than the power consumed in the form of motor pulses for normally driving the hands. For this reason, if this happens, the power of a power source battery of the electronic watch is greatly consumed. If only one motor is employed for rapid watch hand driving, it takes considerable time to rapidly drive all hands to their originally expected positions.

It is an object of the present invention to provide a time measurement device and a time measurement method, which are free from the above problem, and automatically release a suspended state in the middle of time measurement after a predetermined amount of time elapse, thereby shortening the temporary suspension time and reducing power consumed to rapidly driving hands to their originally expected positions when the temporary suspension is released.

SUMMARY OF THE INVENTION

A time measurement device of the present invention has at least, both a function of measuring standard time and a function of measuring any elapsed time, wherein when a predetermined amount of time passes from a temporary suspension of a watch hand in position in the middle of the measurement of the elapsed time, the suspension of the watch hand is automatically released and the watch hand is driven to a watch hand position indicating the elapsed time.

In accordance with another aspect of the invention, the time measurement device automatically releases the temporary suspension of the time measurement when the predetermined amount of time passes since the user temporarily suspended the display of measurement time in the middle of time measurement. For this reason, the time measurement device reduces the power required to drive the watch hand to its originally expected position when the temporary suspension is automatically released. The time measurement device reduces the time required to drive the watch hand to its originally expected position following the automatic release of the temporary suspension of the time measurement. When the user uses such a time measurement device, the time measurement device, even in its temporary suspension state, is automatically released from the temporary suspension state after the predetermined amount of time passes, and this arrangement saves the user the time needed for releasing the temporary suspension state.

A time measurement device of the present invention, includes an elapsed time display mechanism for measuring the duration of time from the start of the temporary suspension of the time measurement to an originally expected watch-hand position at which the watch hand is supposed to be if no temporary suspension takes place, a release section for releasing the temporary suspension by measuring the predetermined amount of time during the temporary suspension, and a watch-hand driving section for driving the watch hand to the originally expected watch hand position, in accordance with the value measured by the elapsed time display mechanism, when the temporary suspension is released.

In accordance with another aspect of the invention, the release section measures time and automatically releases the temporary suspension at the moment the predetermined amount of time passes, after the user temporarily suspended the indication of the measurement time in the middle of the time measurement. For this reason, the time measurement device reduces the power the watch-hand driving section requires to drive the watch hand to the originally expected watch hand position, in accordance with the value measured by the elapsed time display mechanism, when the temporary suspension is automatically released.

A time measurement device of the present invention, includes a first measurement section for managing the position of the watch hand during time measurement, a second measurement section for managing the position of the watch hand in a temporarily suspended state in the middle of time measurement, a release section for releasing the temporary suspension by measuring the predetermined amount of time during the temporary suspension, a comparator section for comparing the position of the watch hand determined by the first measurement section and the position of the watch hand determined by the second measurement section, and a watch-hand driving section for driving the watch hand in accordance with the comparison result provided by the comparator section, which has compared the watch hand position by the first measurement section and the watch hand position by the second measurement section, when the release section releases the temporary suspension after the temporary suspension of the time measurement.

In accordance with another aspect of the invention, when the user temporarily suspends the indication of the measurement time in the middle of the time measurement the second measurement section holds the watch hand position, and the first measurement section measures time normally. The release section measures time and automatically releases the temporary suspension at the moment the predetermined amount of time passes, after the indication of the measurement time is suspended in the middle of the time measurement. For this reason, the time measurement device reduces the power the watch-hand driving section requires to drive the watch hand to the originally expected watch hand position, in accordance with the result provided by the comparator section, when the temporary suspension is automatically released.

A time measurement device of the present invention, includes a standard time display mechanism for measuring standard time, a first motor for driving the standard time display mechanism, an elapsed time display mechanism for measuring any elapsed time, a second motor for driving the elapsed time display mechanism, and a control section for controlling the standard time display mechanism, the first motor, the elapsed time display mechanism and the second motor, wherein the control section automatically releases a temporary suspension when a predetermined amount of time passes form the temporary suspension of the watch hand in position in the middle of the measurement of the elapsed time, and drives the watch hand to a position indicating the elapsed time by operating the second motor.

In accordance with another aspect of the invention, the time measurement device automatically releases the temporary suspension of the time measurement when the predetermined amount of time passes since the user temporarily suspended the indication of measurement time in the middle of time measurement. For this reason, the time measurement device reduces the power the second motor consumes to drive the watch hand to its originally expected position when the temporary suspension is automatically released. When the user uses such a time measurement device, the time measurement device, even in its temporary suspension state, is automatically released from the temporary suspension state after the predetermined amount of time passes, and this arrangement saves the user the time needed for releasing the temporary suspension state.

In a time measurement device of the present invention, the control section includes a counter, wherein the counter counts up when the time measurement is temporarily suspended in the middle of the measurement of the elapsed time, and counts down while the watch hand is rapidly driven when the temporary suspension is released, and the rapid driving of the watch hand is stopped when the counter reaches zero.

In a time measurement device of the present invention, the temporary suspension is automatically released, and a subsequent temporary suspension is inhibited while the watch hand is driven to the watch hand position indicating the elapsed time.

In accordance with an aspect of the invention, the temporary suspension is automatically released when the predetermined amount of time passes since the user suspended the indication of the elapsed time under measurement in the middle of time measurement. The watch hand is rapidly driven to the originally expected watch hand position indicating the elapsed time. If the temporary suspension is attempted again during the rapid driving of the watch hand, such temporary suspension is inhibited.

In a time measurement device of the present invention, the control section includes a first counter for counting the measurement time of the elapsed time display mechanism, and a second counter for counting the position of the watch hand at the measurement time, wherein the first counter counts up even when the time measurement is suspended in the middle of the measurement of the elapsed time, the control section drives the watch hand to the originally expected watch hand position when the temporary suspension is released, and stops a rapid driving of the watch hand when the count at the second counter coincides with the count at the first counter.

In accordance with an aspect of the invention, the control section includes the counters for managing the temporary suspension time throughout which the indication of the time measurement is suspended. When the user temporarily suspends the watch hand position in the middle of the measurement of any time, the counter in the control section manages the temporary suspension time. When the temporary suspension is automatically released, the watch hand is rapidly driven in accordance with the count of the counter. For this reason, the time measurement device reduces the power the second motor consumes to drive the watch hand to the originally expected watch hand position when the temporary suspension is automatically released.

In a time measurement device of the present invention, a single motor is used for driving the watch hand indicating the elapsed time.

In accordance with another aspect of the invention the function for measuring time employs the single motor. In the construction in which the watch hand is driven by the single motor, even when the user forgets to release the temporary suspension of the time measurement in the middle of time measurement, thereby leaving the time measurement device in the temporary suspension state, the time measurement device reduces the power that is consumed to drive the watch hand to the originally expected watch hand position, by automatically releasing the temporary suspension.

A time measurement device of the present invention, includes a generator for generating power.

In accordance with an aspect of the invention, the time measurement device includes the generator, and does not require a conventional button battery or the like, and the user uses the time measurement device, only in time of need, by simply letting it generate power.

A time measurement method of the present invention, has, at least, both a function of measuring standard time and a function of measuring any elapsed time, wherein when a predetermined amount of time passes a temporary suspension of a watch hand in position in the middle of the measurement of the elapsed time, the suspension of the watch hand is automatically released and the watch hand is driven to a watch hand position indicating the elapsed time.

In accordance with an aspect of the invention the time measurement method automatically releases the temporary suspension of the time measurement when the predetermined amount of time passes since the user temporarily suspended the indication of measurement time in the middle of time measurement. For this reason, the time measurement method reduces the power required to drive the watch hand to its originally expected position when the temporary suspension is automatically released. The time measurement method reduces the time required to drive the watch hand to its originally expected position following to the automatic release of the temporary suspension of the time measurement. When the user uses such a time measurement method, the time measurement, even in its temporary suspension state, is automatically released from the temporary suspension state after the predetermined amount of time passes, and this arrangement saves the user the time needed for releasing the temporary suspension state.

A time measurement method of the present invention, includes the measuring step of measuring the duration of time from the start of the temporary suspension of the time measurement to an originally expected watch-hand position at which the watch hand is supposed to be if no temporary suspension takes place, the releasing step of releasing the temporary suspension by measuring the predetermined amount of time during the temporary suspension, and the watch-hand driving step of driving the watch hand to the originally expected watch hand position, in accordance with the value measured in the time measuring step, when the temporary suspension is released.

In accordance with an aspect of the invention the releasing step measures time and automatically releases the temporary suspension at the moment the predetermined amount of time passes, after the user temporarily suspended the indication of the measurement time in the middle of the time measurement. For this reason, the time measurement method reduces the power the watch-hand driving step requires to drive the watch hand to the originally expected watch hand position, in accordance with the value measured in the measuring step, when the temporary suspension is automatically released.

A time measurement method of the present invention, includes the first measuring step for managing the position of the watch hand during time measurement, the second measuring step for managing the position of the watch hand in a temporarily suspended state in the middle of time measurement, the releasing step for releasing the temporary suspension by measuring the predetermined amount of time during the temporary suspension, the comparing step for comparing the position of the watch hand determined in the first measuring step and the position of the watch hand determined in the second measuring step, and the watch-hand driving step for driving the watch hand in accordance with the comparison result provided in the comparing step, which has compared the watch hand position in the first measuring step and the watch hand position in the second measuring step, when the releasing step releases the temporary suspension after the temporary suspension of the time measurement.

In accordance with another aspect of the invention, when the user temporarily suspends the indication of the measurement time in the middle of the time measurement, the second measuring step holds the watch hand position and the first measuring step measures time normally. The releasing step measures time and releases the temporary suspension at the moment the predetermined amount of time passes, after the indication of the measurement time is suspended in the middle of the time measurement. For this reason, the time measurement method reduces the power the watch-hand driving step requires to drive the watch hand to the originally expected watch hand position, in accordance with the result provided in the comparing step, when the temporary suspension is automatically released.

In a time measurement method of the present invention, the control section controls a standard time display mechanism for measuring standard time, a first motor for driving the standard time display mechanism, an elapsed time display mechanism for measuring any elapsed time, and a second motor for driving the elapsed time display mechanism, and automatically releases a temporary suspension when a predetermined amount of time passes from the temporary suspension of the watch hand in position in the middle of the measurement of the elapsed time, and drives the watch hand to a position indicating the elapsed time by operating the second motor.

In accordance with another aspect of the invention, the time measurement method automatically releases the temporary suspension of the time measurement when the predetermined amount of time passes since the user temporarily suspended the indication of measurement time in the middle of time measurement. For this reason, the time measurement method reduces the power the second motor consumes to drive the watch hand to its originally expected position when the temporary suspension is automatically released. When the user uses such a time measurement method, the time measurement, even in its temporary suspension state, is automatically released from the temporary suspension state after the predetermined amount of time passes, and this arrangement saves the user the time needed for releasing the temporary suspension state.

In a time measurement method of the present invention, a counter arranged in the control section counts up when the time measurement is temporarily suspended in the middle of the measurement of the elapsed time, counts down while the watch hand is rapidly driven when the temporary suspension is released, and the rapid driving of the watch hand is stopped when the counter reaches zero.

In a time measurement method of the present invention, the control section causes a first counter to count the measurement time of the elapsed time display mechanism, and a second counter to count the position of the watch hand at the measurement time, wherein the first counter counts up even when the time measurement is suspended in the middle of the measurement of the elapsed time, the control section drives the watch hand to the originally expected watch hand position when the temporary suspension is released, and stops a rapid driving of the watch hand when the count at the second counter coincides with the count at the first counter.

In accordance with an aspect of the invention, the control section includes the counters for managing the temporary suspension time throughout which the indication of the time measurement is suspended. When the user temporarily suspends the hand position in the middle of the measurement of any time, the counter in the control section manages the temporary suspension time. When the temporary suspension is automatically released, the watch hand is rapidly driven in accordance with the count of the counter. For this reason, the time measurement method reduces the power the second motor consumes to drive the watch hand to the originally expected watch hand position when the temporary suspension is automatically released.

BRIEF DESCRIPTION OF THE DRAWINGS

FIG. 17 is a block diagram showing the construction of a control circuit used in the electronic watch of FIG. 1.

DETAILED DESCRIPTION

Figure 1:
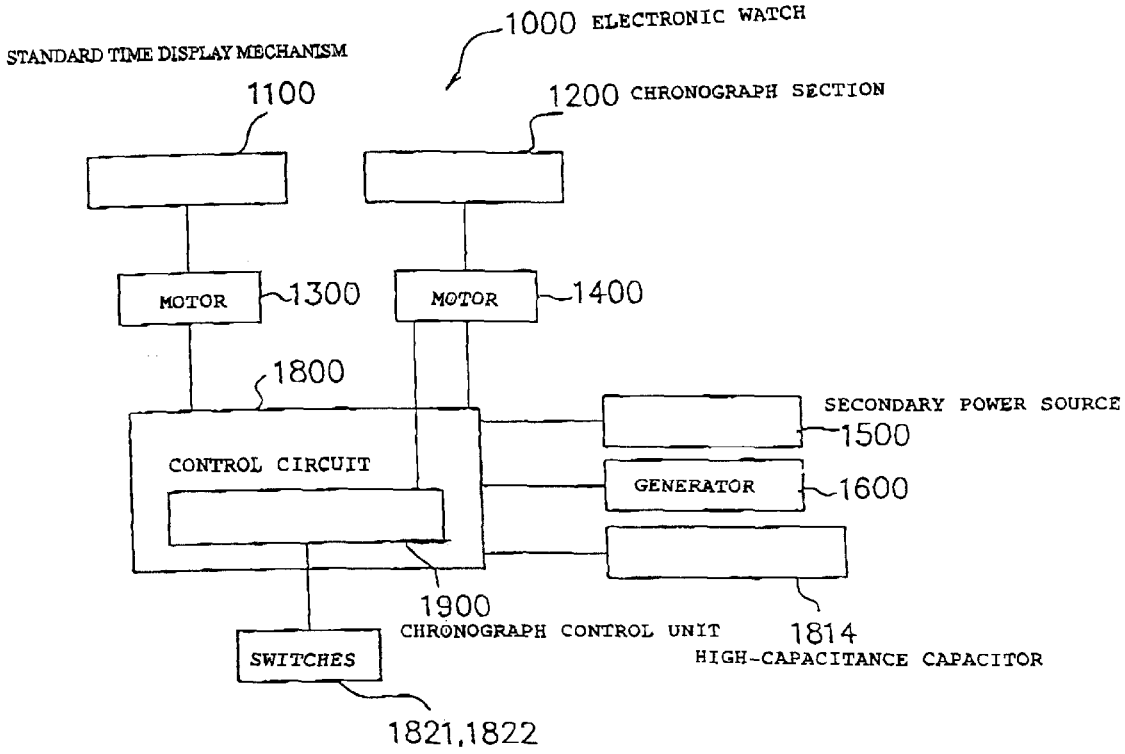
FIG. 1 is a block diagram showing one embodiment of an electronic watch as a time measurement device of the present invention.

Referring to the drawings, preferred embodiments of the present invention are discussed.

FIG. 1 is a block diagram showing one embodiment of an electronic watch as a time measurement device of the present invention.

The electronic watch 1000 includes two motors 1300 and 1400 for respectively driving a standard time display mechanism 1100 and a chronograph section 1200, a high-capacitance capacitor 1814 and a secondary power source 1500 for feeding power to drive the motors 1300 and 1400, a generator 1600 for charging the secondary power source 1500, and a control circuit 1800 for generally controlling the electronic watch 1000. The control circuit 1800 includes a chronograph control unit 1900 having switches 1821 and 1822 for controlling the chronograph section 1200 in a method to be described later.

The electronic watch 1000 is an analog electronic watch having a chronograph function, and includes two motors 1300 and 1400, separately operated from power generated by a single generator 1600, for performing watch-hand driving for the standard time display mechanism 1100 and the chronograph section 1200. The resetting (zero resetting) of the chronograph section 1200 is performed mechanically, rather than by motor driving.

Figure 2:
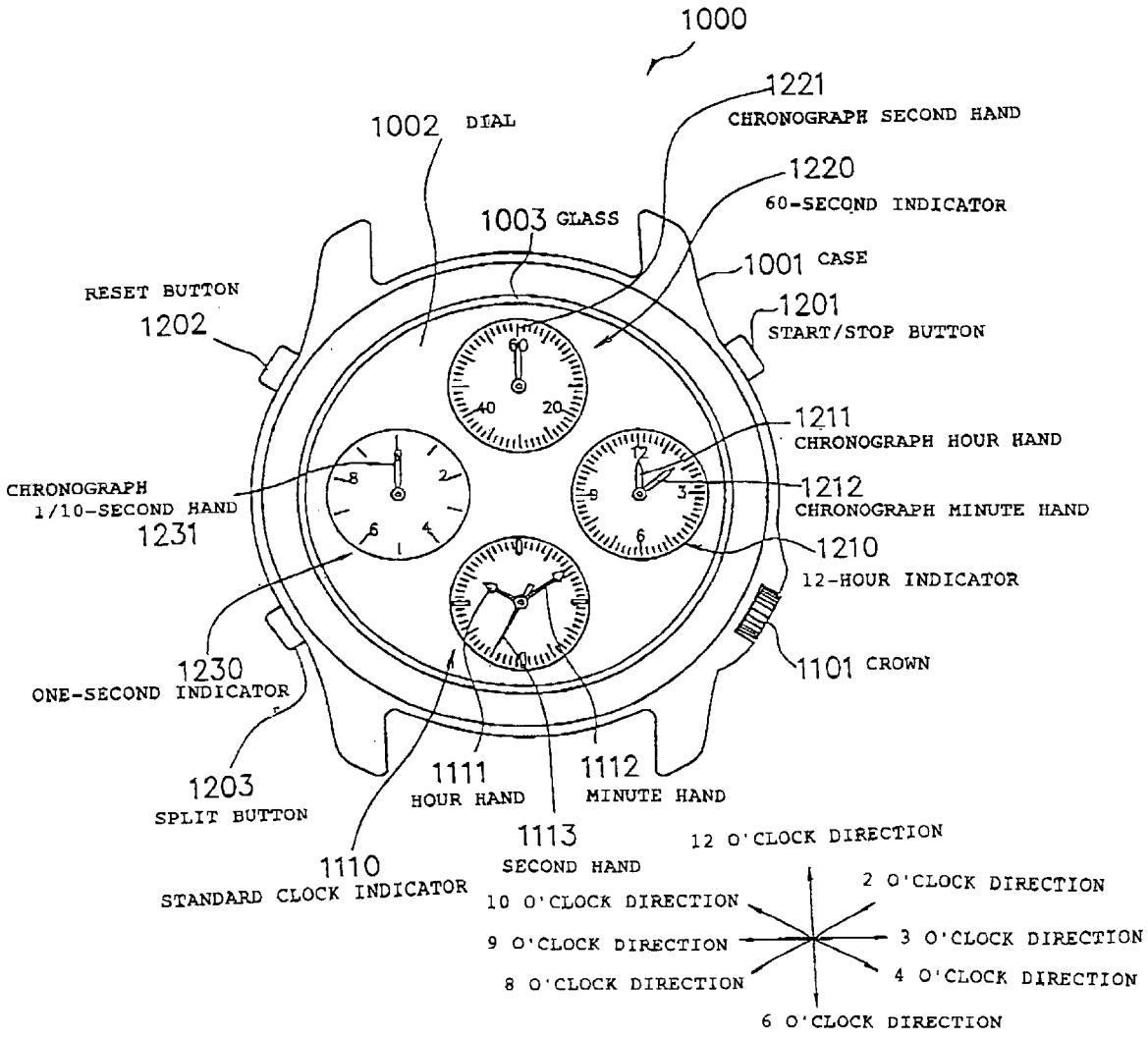
FIG. 2 is a plan view showing the external appearance of the electronic watch of FIG. 1.

FIG. 2 is a plan view showing the external appearance of the finished construction of the electronic watch shown in FIG. 1.

In the electronic watch 1000, a dial 1002 and a glass cover 1003 are fitted into a case 1001. A crown 1101 as an external control is mounted on the case 1001 at its 4 o'clock position, and a start/stop button (a first switch) 1201 and a reset button 1201 (a second switch) are respectively arranged at a 2 o'clock position and a 10 o'clock position.

A standard clock indicator 1110 having an hour hand 1111, a minute hand 1112, and a second hand 1113 as watch hands for indicating standard time is arranged at a 6 o'clock position of the dial 1002, and indicators 1210, 1220, and 1230 having chronograph auxiliary watch hands are respectively arranged at 3 o'clock, 12 o'clock, and 9 o'clock positions of the dial. Specifically, the 12-hour indicator 1210 having chronograph hour and minute hands 1211 and 1212 is arranged at the 3 o'clock position of the dial, the 60-second indicator 1220 having a chronograph second hand 1221 is arranged at the 12 o'clock position of the dial, and the one-second indicator 1230 having a chronograph 1/10-second hand 1231 is arranged at the 9 o'clock position of the dial.

Figure 3:
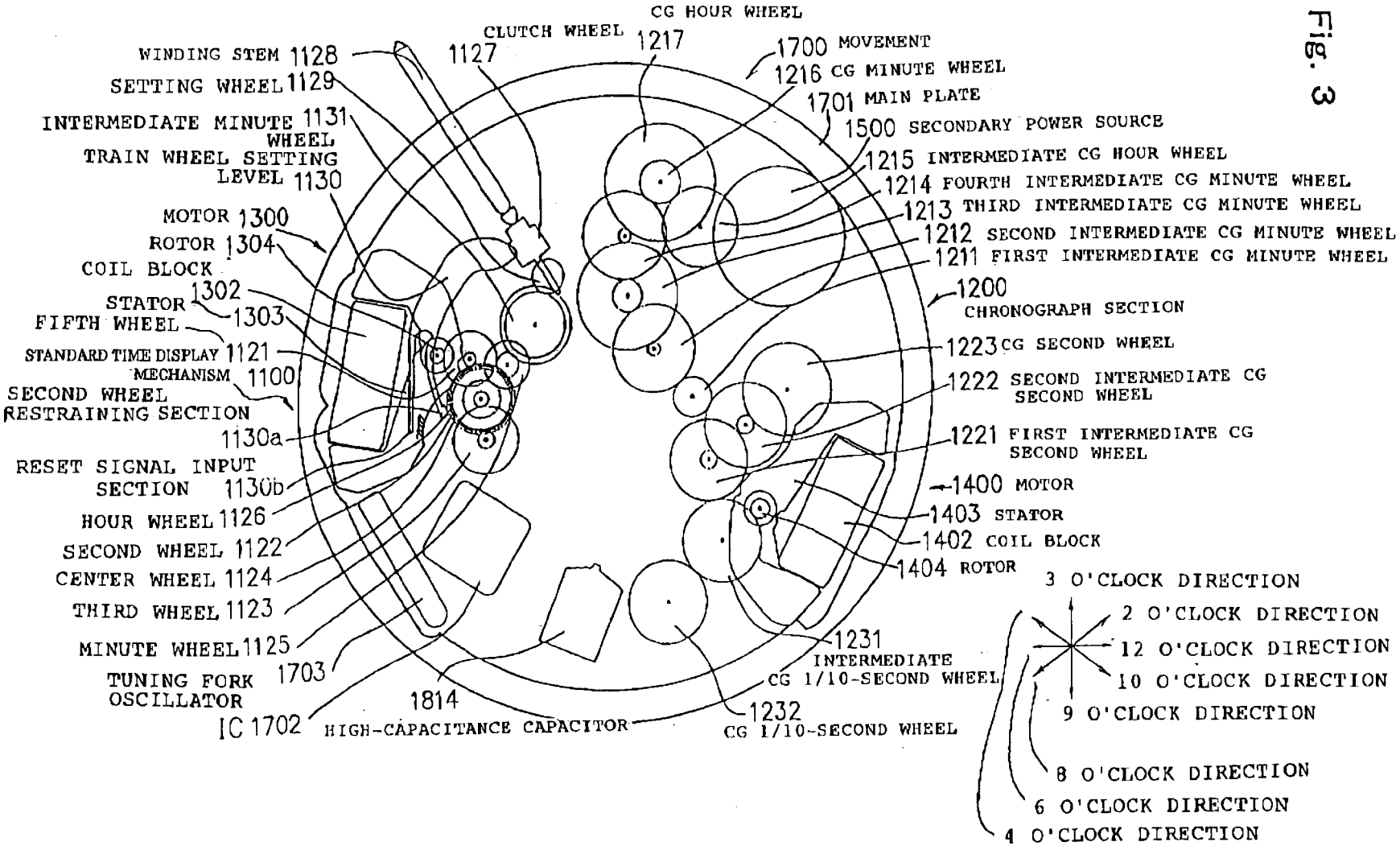
FIG. 3 is a plan view showing the construction of the movement of the electronic watch when viewed from behind.

FIG. 3 is a plan view roughly showing a movement of the electronic watch of FIG. 2, when viewed from behind.

The movement 1700 includes, at the 6 o'clock position of a main plate 1701, the standard time display mechanism 1100, the motor 1300, IC 1702, a tuning fork oscillator 1703, etc, and, at the 12 o'clock position of the main plate 1701, the chronograph section 1200, the motor 1400, and the secondary power source 1500 such as a lithium ion power source.

The motors 1300 and 1400 are step motors, and respectively include coil blocks 1302 and 1402, each having a core constructed of a high-permeability material, stators 1303 and 1403, each constructed of a high-permeability material, and rotors 1304 and 1404, each composed of a rotor magnet and a rotor pinion.

The standard time display mechanism 1100 includes train wheels of a fifth wheel 1121, a second wheel 1122, a third wheel 1123, a center wheel 1124, a minute wheel 1125, and an hour wheel 1126, and the arrangement of these train wheels presents the seconds, minutes and hours of standard time.

Figure 4:
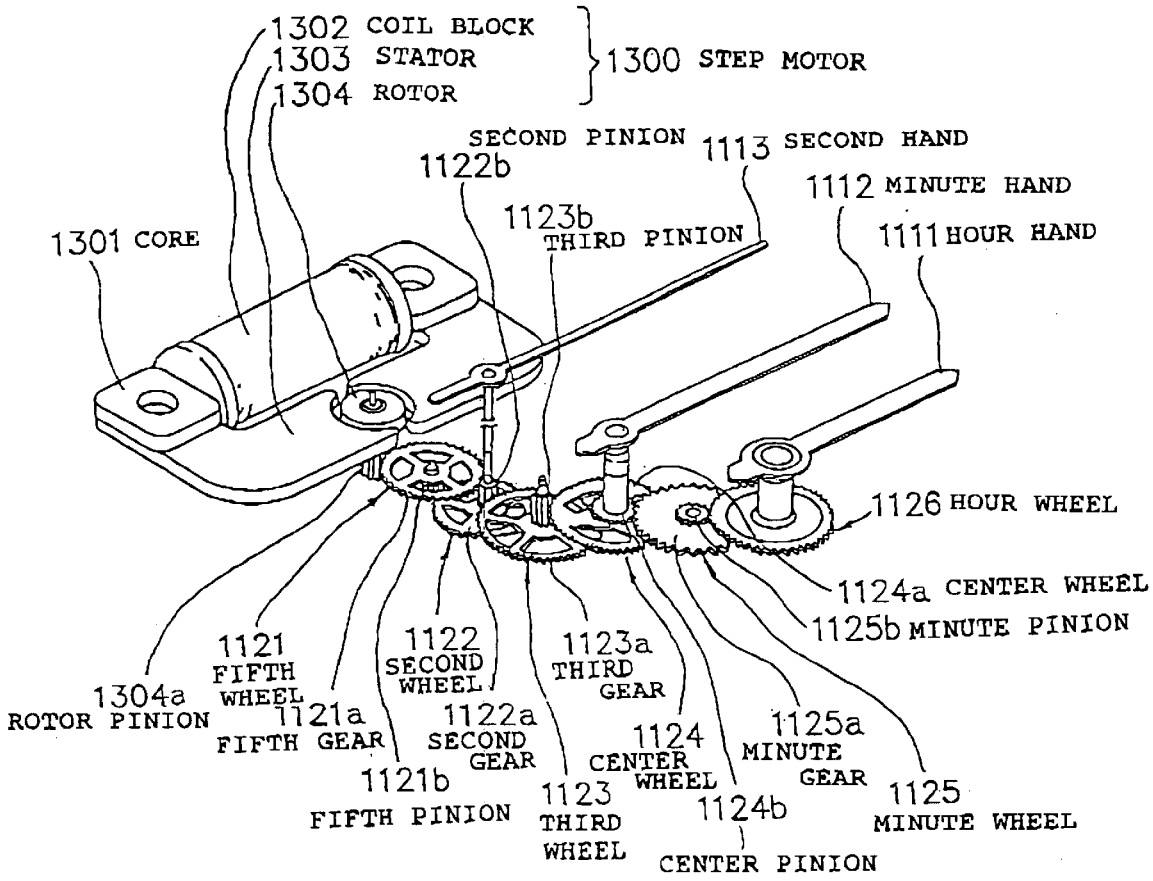
FIG. 4 is a perspective view showing an engagement state of train wheels in the standard time display mechanism in the movement of the electronic watch shown in FIG. 2.

FIG. 4 is a perspective view showing an engagement state of the train wheels in the standard time display mechanism 1100.

A rotor pinion 1304*a* is in mesh with a fifth gear 1121*a*, and a fifth pinion 1121*b* is in mesh with a second gear 1122*a*. The rotor pinion 1304*a* through the second gear 1122*a* feature a gear reduction ratio of 1/30. An electrical signal from IC 1702 is output to cause a rotor 1304 to rotate half a revolution per second, the second wheel 1122 rotates once every 60 seconds, and the second hand 1113, attached to one end of the shaft of the second wheel 1122, indicates the seconds of standard time.

The second pinion 1122*b* is in mesh with a third gear 1123*a*, and a third pinion 1123*b* is in mesh with a center gear 1124*a*. The second pinion 1122*b* through the center gear 1124*a* feature a gear reduction ratio of 1/60. The center wheel 1124 rotates once every 60 minutes, and the minute hand 1112, attached to one end of the shaft of the center wheel 1124, indicates the minutes of standard time.

A center pinion 1124*b* is in mesh with a minute gear 1125*a*, and a minute pinion 1125*b* is in mesh with the hour wheel 1126. The center pinion 1124*b* through the hour wheel 1126 feature a gear reduction ratio of 1/12, and the hour wheel 1126 rotates once every 12 hours, and the hour hand 1111, attached to one end of the shaft of the hour wheel 1126, indicates the hours of standard time.

Referring to FIG. 2 and FIG. 3, the standard time display mechanism 1100 includes a winding stem 1128, one end to which the crown 1101 is connected and the other end to which a clutch wheel 1127 is attached, a setting wheel 1129, winding stem setting means, and a train wheel setting lever 1130. The winding stem 1128 is stepwise pulled out with the crown 1101. The winding stem 1128, when not in its pulled state (zero step), is in its normal state. When the winding stem 1128 is pulled out to a first step, calendar correction is performed without stopping the hour hand 1111 and the like, and when the winding step 1128 is pulled out to a second step, the watch hand driving is suspended permitting the user to set time.

When the winding stem 1128 is pulled out to the second step by pulling the crown 1101, a reset signal input section 1130*b* arranged on the train wheel setting lever 1130, which is engaged with the winding stem setting means, is put into contact with a pattern of a circuit board having IC 1702 thereon, and the output of motor pulse stops, suspending the watch-hand driving. Then, a second wheel restraining section 1130*a*, arranged on the train wheel setting lever 1130, restrains the rotation of the second gear 1122*a*. When the crown 1101 is rotated along with the winding stem 1128 in this state, the rotation of the crown 1101 is transmitted to the minute wheel 1125 through the clutch wheel 1127, setting wheel 1129, and intermediate minute wheel 1131. Since the center gear 1124*a* is coupled with the center pinion 1124*b* with a constant slip permitted therebetween, the setting wheel 1129, minute wheel 1125, center pinion 1124*b*, and hour wheel 1126 are still rotatable even if the second wheel 1122 is restrained. The minute hand 1112 and hour hand 1111 still turn, permitting the user to set time.

Referring to FIG. 2 and FIG. 3, the chronograph section 1200 includes train wheels of an intermediate CG (chronograph) 1/10-second wheel 1231 and CG 1/10-second wheel 1232, and the CG 1/10-second wheel 1232 is arranged in the center of the one-second indicator 1230. The arrangement of these train wheels presents the tenths of a second of the chronograph at the 9 o'clock position of the watch body.

Referring to FIG. 2 and FIG. 3, the chronograph section 1200 includes train wheels of a first intermediate CG second wheel 1221, a second intermediate CG second wheel 1222, and a CG second wheel 1223, and the CG second wheel 1223 is arranged in the center of the 60-second indicator 1220. This arrangement of these train wheels indicates the seconds of chronograph at the 12 o'clock position of the watch body.

Referring to FIG. 2 and FIG. 3, the chronograph section 1200 includes train wheels of a first intermediate CG minute wheel 1211, a second intermediate CG minute wheel 1212, a third intermediate CG minute wheel 1213, a fourth intermediate minute wheel 1214, an intermediate CG hour wheel 1215, a CG minute wheel 1216, and a CG hour wheel 1217, and the CG minute wheel 1216 and CG hour wheel 1217 are coaxially arranged in the center of the 12-hour indicator 1210. This arrangement of these train wheels indicates the hours of the chronograph at the 3 o'clock position of the watch body.

Figure 5:
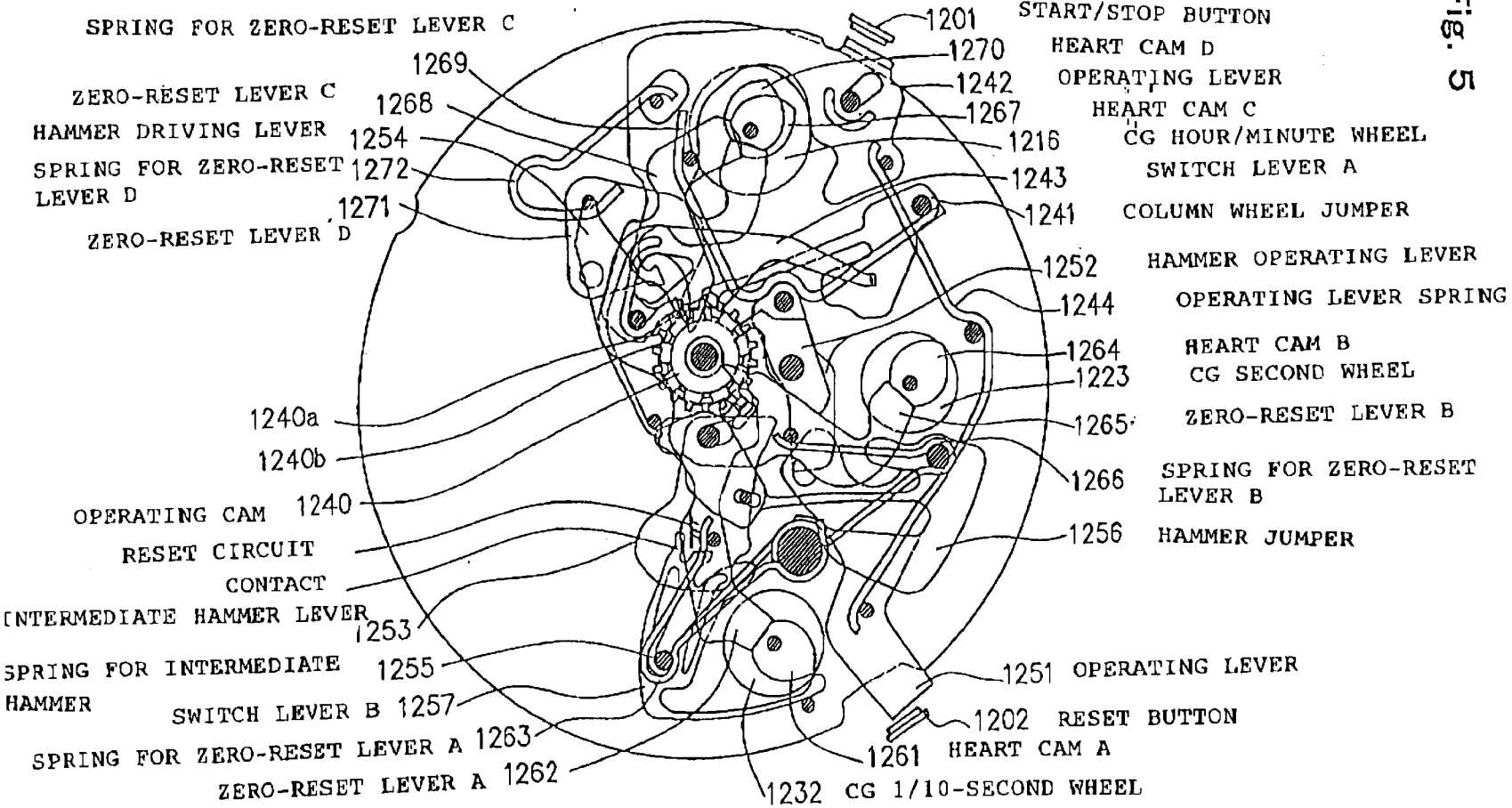
FIG. 5 is a plan view roughly showing an operating mechanism for start/stop and (zero) reset in a chronograph section of the electronic watch of FIG. 2.
Figure 6:
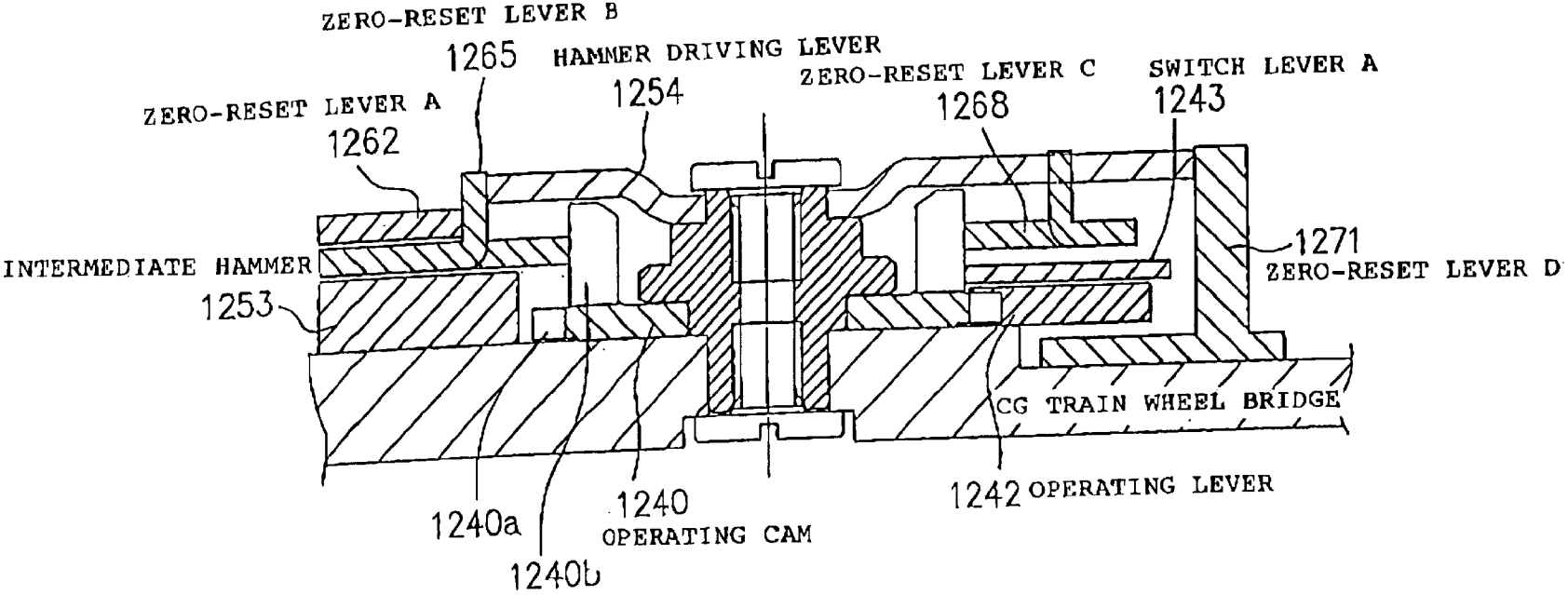
FIG. 6 is a sectional side view roughly showing a major portion of the operating mechanism for start/stop and (zero) reset in the chronograph section of FIG. 5.

FIG. 5 is a plan view roughly showing the operating mechanisms for start/stop and resetting (zero resetting) in the chronograph section 1200, when viewed from behind. FIG. 6 is a sectional side view roughly showing a major portion of the operating mechanism. These figures show the reset state of the watch.

The operating mechanisms for start/stop and resetting of the chronograph section 1200 are arranged on the movement shown in FIG. 3, and the start/stop and reset operations are mechanically carried out with an operating cam 1240 rotated almost in the center of the movement. The operating cam 1240 has a cylindrical shape, and has teeth 1240*a* arranged around the circumference at a regular pitch, and a ring of columns 1240*b* at a regular pitch on one end thereof. The operating cam 1240 is restrained in phase during a stationary state by a column wheel jumper 1241 engaged between one tooth 1240*a* and another tooth 1240*a*, and is counterclockwise rotated by an operating cam rotary portion 1242*d* attached to the end of an operating lever 1242.

Figure 7:
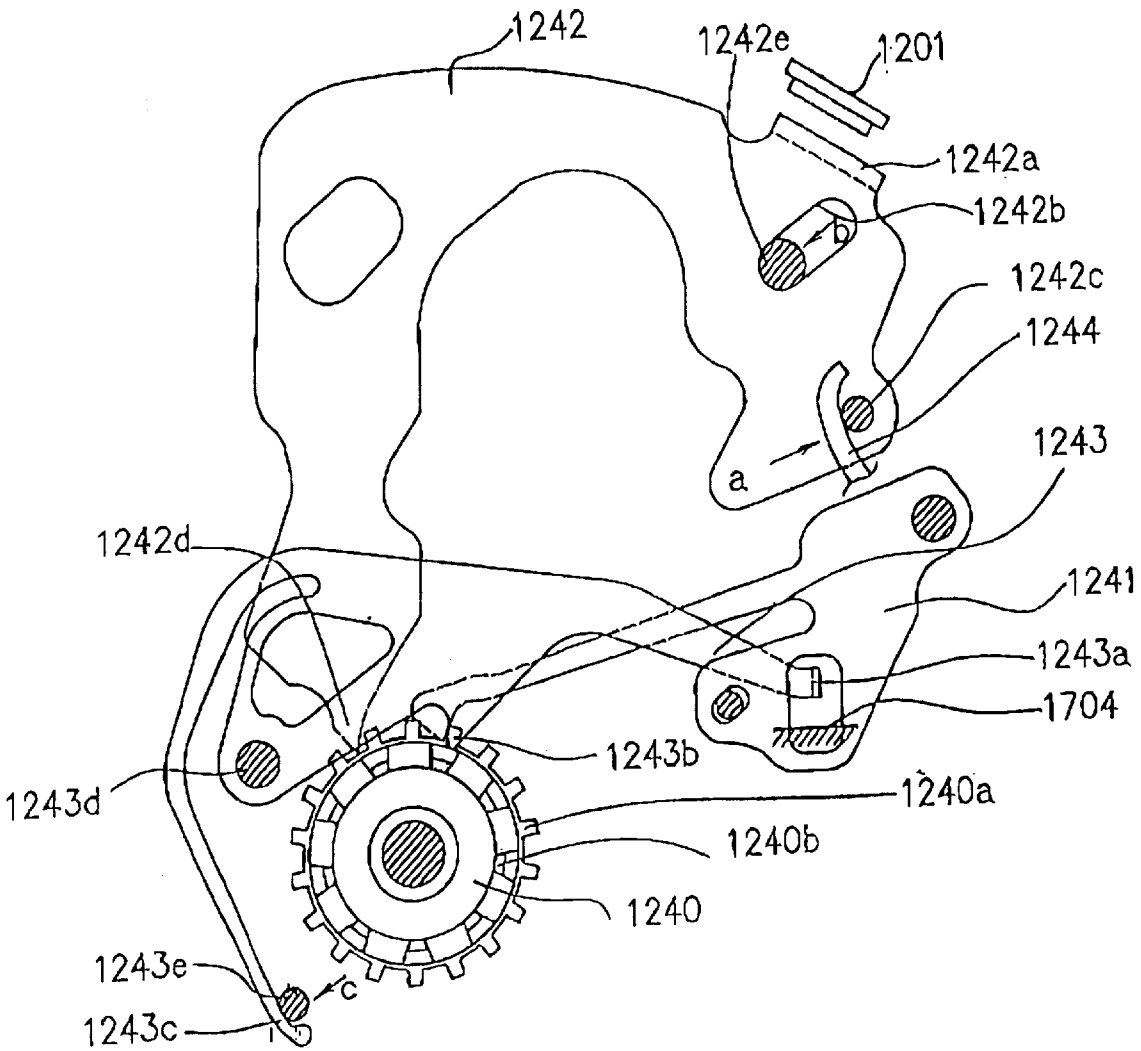
FIG. 7 is a first plan view showing the operational example of the start/stop operating mechanism in the chronograph of FIG. 5.

The start/stop operating mechanism (the first switch), as shown in FIG. 7, includes the operating lever 1242, a switch lever A 1243, and an operating lever spring 1244.

The operating lever 1242, having a generally L-shape planar structure, includes, on one end, a pressure portion 1242*a*, formed in a bent state, an elliptical through hole 1242*b*, and a pin 1242*c*, and on the other end, an acute angle pressure portion 1242*d*. Such an operating lever 1242 constitutes the start/stop operating mechanism, in which the pressure portion 1242*a* faces the start/stop button 1201, a pin 1242*e*, affixed to the movement, is received within the through hole 1242*b*, the pin 1242*c* is engaged with one end of the operating lever spring 1244, and the pressure portion 1242*d* is placed in the vicinity of the operating cam 1240.

The switch lever A 1243 has, on one end, a switch portion 1243*a*, on its generally central position, a planar projection 1243*b*, and on the other end, a lock portion 1243*c*. Such a switch lever A 1243, on its almost central position, is pivotally supported about a pin 1243*d*, which is affixed to the movement, and constitutes the start/stop operating mechanism, in which the switch portion 1243*a* is placed in the vicinity of a start circuit of a circuit board 1704, the projection 1243*b* is placed to be in contact with the column 1240*b* extending longitudinally along the operating cam 1240, and the lock portion 1243*c* is engaged with the pin

1243*e* affixed to the movement. Specifically, the switch portion 1243*a* of the switch lever A 1243 is put into contact with the start circuit of the circuit board 1704, thereby turning the switch on. The switch lever A 1243, electrically connected to the secondary power source 1500 via the main plate 1701, etc., has the same potential as that of the positive electrode of the secondary power source 1500.

The operational example of the start/stop operating mechanism thus constructed is now discussed in connection with the startup operation of the chronograph section 1200, referring to FIG. 7 through FIG. 9.

When the chronograph section 1200 is in a stop state, the operating lever 1242 is set, as shown in FIG. 7, as follows: the pressure portion 1242*a* is disengaged from the start/stop button 1201, the pin 1242*c* is urged under the elastic force of the operating lever spring 1244 in the direction of an arrow a as shown, and the through hole 1242*b* is positioned with the pin 1242*e* abutting one end of the through hole 1242*b* in the direction of an arrow b as shown. The end portion 1242*d* of the operating lever 1242 is positioned between one tooth 1240*a* and another tooth 1240*a* of the operating cam 1240.

The switch lever A 1243 is set as follows: the projection 1243*b* is outwardly pressed by the column 1240*b* of the operating cam 1240 against the urging of the spring portion 1243*c* on the other end of the switch lever A 1243, and the switch lever A 1243 is thus positioned under the urging of the pin 1243*e* in the direction of an arrow c as shown. The switch portion 1243*a* of the switch lever A 1243 remains detached from the start circuit of the circuit board 1704, and the start circuit is electrically not conductive.

Figure 8:
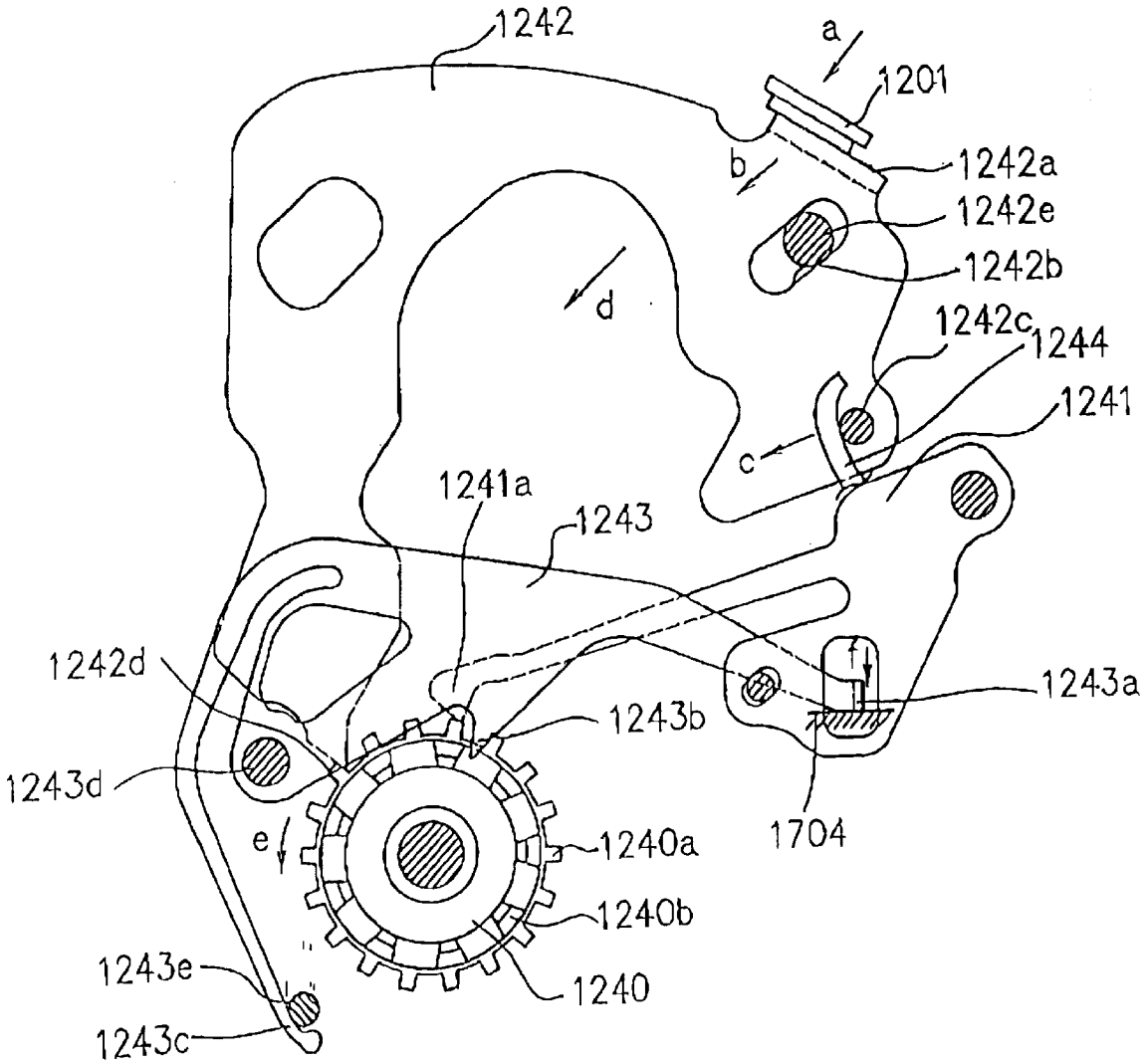
FIG. 8 is a second plan view showing the operational example of the start/stop operating mechanism in the chronograph of FIG. 5.

When the start/stop button 1201 is pressed in the direction of an arrow a as shown in FIG. 8 to activate the chronograph section 1200 from the above state, the start/stop button 1201 is put into contact with the pressure portion 1242*a* of the operating lever 1242, thereby pressing the pressure portion 1242*a* in the direction of an arrow b as shown. The pin 1242*c* presses and elastically deforms the operating lever spring 1244 in the direction of an arrow c as shown. The entire operating lever 1242 moves in the direction of an arrow d with the through hole 1242*b* and the pin 1242*e* working as guides. The end portion 1242*d* of the operating lever 1242 abuts the side face of the tooth 1240*a* of the operating cam 1240, thereby rotating the operating cam 1240 in the direction of an arrow e as shown.

The rotation of the operating cam 1240 causes the projection 1243*b* of the switch lever A 1243 to be out of phase with the side face of the column 1240*b*, and the projection 1243*b* comes and is placed between one column 1240*b* and another column 1240*b* by means of the restoring force of the spring portion of the 1243*c*. The switch portion 1243*a* of the switch lever A 1243 pivots in the direction of an arrow f, as shown, contacting the start circuit of the circuit board 1704 and driving the start circuit into an electrically conductive state.

An end portion 1241*a* of the column wheel jumper 1241 is now pressed outwardly by the tooth 1240*a* of the operating cam 1240.

The above operation continues until the teeth 1240*a* of the operating cam 1240 is rotated by one pitch.

Figure 9:
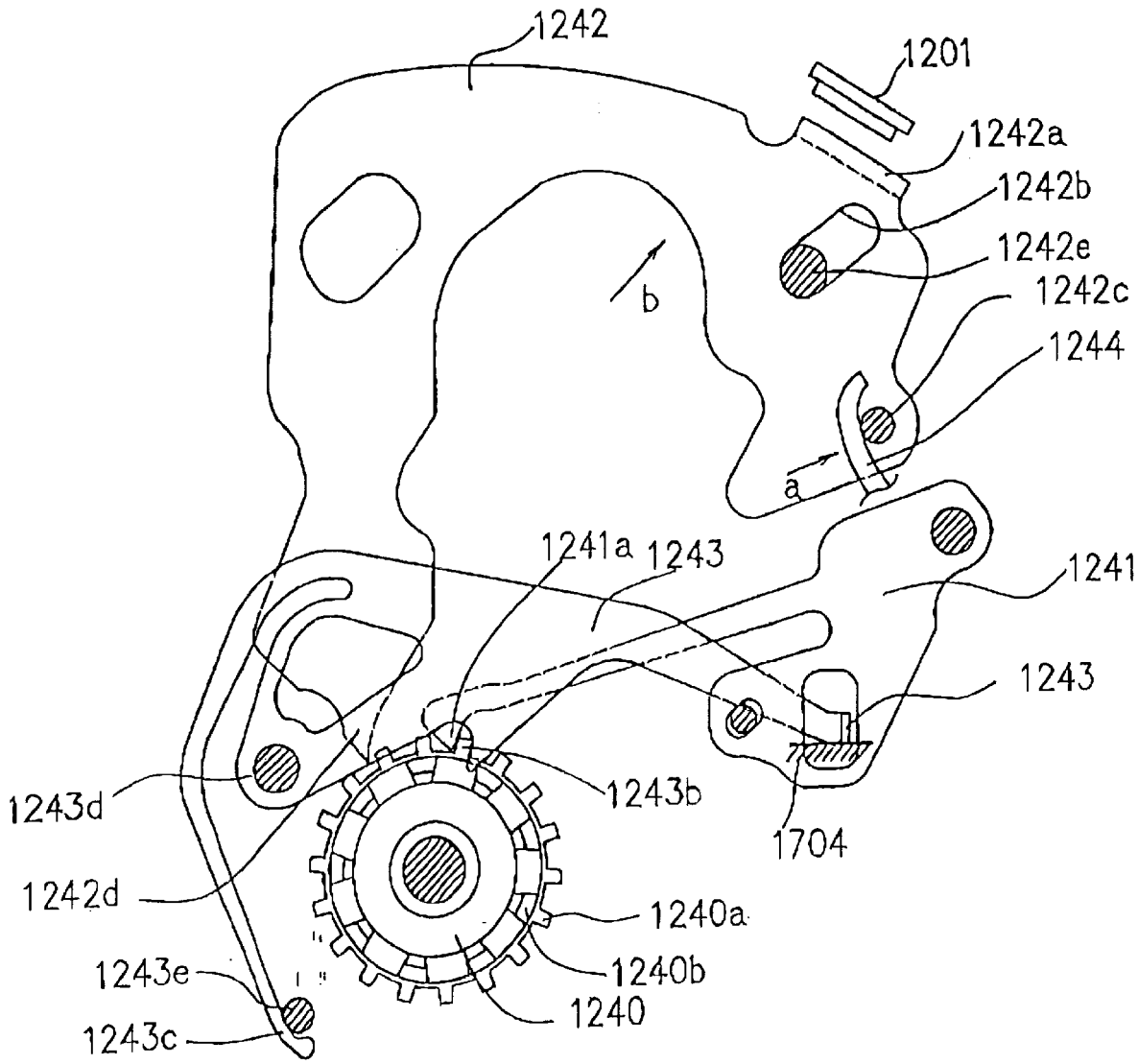
FIG. 9 is a third plan view showing the operational example of the start/stop operating mechanism in the chronograph of FIG. 5.

When the user releases the start/stop button 1201, the start/stop button 1201 automatically reverts back to its original state by means of a built-in spring as shown in FIG. 9. The pin 1242*c* of the operating lever 1242 is urged by the restoring force of the operating lever spring 1244 in the direction of an arrow a. The entire operating lever 1242 moves with the through hole 1242*b* and the pin 1242*e* working as the guides in the direction of an arrow b until the one end side wall of the through hole 1242*b* abuts the pin 1242*e*, and thereby the operating lever 1242 reverts back to its position as shown in FIG. 7.

The projection portion 1243*b* of the switch lever A 1243 remains inserted in the gap between one column 1240*b* and another column 1240*b* of the operating cam 1240, the switch portion 1243*a* remains in contact with the start circuit of the circuit board 1704, and the start circuit maintains its electrically conductive state. The chronograph section 1200 therefore maintains its start state.

The projection portion 1241*a* of the column wheel jumper 1241 is inserted between one tooth 1240*a* and another tooth 1240*a* of the operating cam 1240, and sets the phase in the rotation of the operating cam 1240 in its stationary state.

To stop the chronograph section 1200, the same operation as that at the start is carried out, and the chronograph section 1200 reverts back to the state shown in FIG. 7.

As described above, pushing in the start/stop button 1201 moves the operating lever 1242, rotating the operating cam 1240, and pivoting the switch lever A 1243, and the start/stop operation of the chronograph section 1200 is thus controlled.

Referring to FIG. 5, the reset operating mechanism (second switch) includes the operating cam 1240, operating lever 1251, hammer operating lever 1252, intermediate hammer 1253, hammer driving lever 1254, operating lever spring 1244, intermediate hammer spring 1255, hammer jumper 1256, and switch lever B 1257. The reset operating mechanism further includes a heart cam A 1261, zero reset lever A 1262, zero reset lever A spring 1263, heart cam B 1264, zero reset lever B 1265, zero reset lever B spring 1266, heart cam C 1267, zero reset lever C 1268, zero reset lever C spring 1269, heart cam D 1270, zero reset lever D 1271, and zero reset lever D spring 1272.

The reset operating mechanism of the chronograph section 1200 is designed not to be activated in the start state of the chronograph section 1200 but is designed to be activated in the stop state of the chronograph section 1200. This system is called a safety mechanism, and the safety mechanism, composed of the operating lever 1251, hammer operating lever 1252, intermediate hammer 1253, operating lever spring 1244, intermediate hammer spring 1255, and hammer jumper 1256, is now discussed, referring to FIG. 10.

The operating lever 1251, having a generally Y-shape planar structure, includes a pressure portion 1251*a* on one end, a elliptical through hole 1251*b* near one bifurcated end, and a pin 1251*c* at a midway point between the pressure portion 1251*a* and the through hole 1251*b*. The operating lever 1251 constitutes the reset operating mechanism, in which the pressure portion 1251*a* faces a reset button 1202, a pin 1252*c* of the hammer operating lever 1252 is received within the through hole 1251*b*, the other bifurcated end of the operating lever 1251 is pivotally supported about a pin 1251*d* affixed to the movement, and the pin 1251*c* is engaged with the other end of the operating lever spring 1244.

The hammer operating lever 1252 is composed of a first hammer operating lever member 1252*a* and a second hammer operating lever member 1252*b*, each having a generally rectangular planar structure. The first hammer operating lever member 1252*a* and second hammer operating lever member 1252*b* are stacked and mutually pivotally supported about a shaft 1252*g*. The pin 1252*c* is attached to one end of the first hammer operating lever member 1252*a*, and the second hammer operating lever member 1252*b* has a pressure portion 1252*d* and a pressure portion 1252*e* on both ends. The hammer operating lever 1252 constitutes the reset operating mechanism, in which the pin 1252*c* is received within the through hole 1251*b* of the operating lever 1251, the other end of the first hammer operating lever member 1252*a* is pivotally supported at a pin 1252*f* affixed to the movement, the pressure portion 1252*d* faces a pressure portion 1253*c* of the intermediate hammer 1253, and the pressure portion 1252*e* is positioned in the vicinity of the operating cam 1240.

The intermediate hammer 1253, having a generally rectangular planar structure, includes, a pin 1253*a* on one end portion, a pin 1253*b* in the middle portion, and the pressure portion 1253*c* near one corner of the other end portion. The intermediate hammer 1253 constitutes the reset mechanism, in which one end of the intermediate hammer spring 1255 is anchored at the pin 1253*a*, one end of the hammer jumper 1256 is engaged with the pin 1253*b*, the pressure portion 1253*c* faces the pressure portion 1252*d* of the second hammer operating lever member 1252*b*, and the one corner of the other end of the intermediate hammer 1253 is pivotally supported at the pin 1253*d* affixed to the movement.

The operational example of the safety mechanism thus constructed is now discussed, referring to FIG. 10 through FIG. 13.

Figure 10:
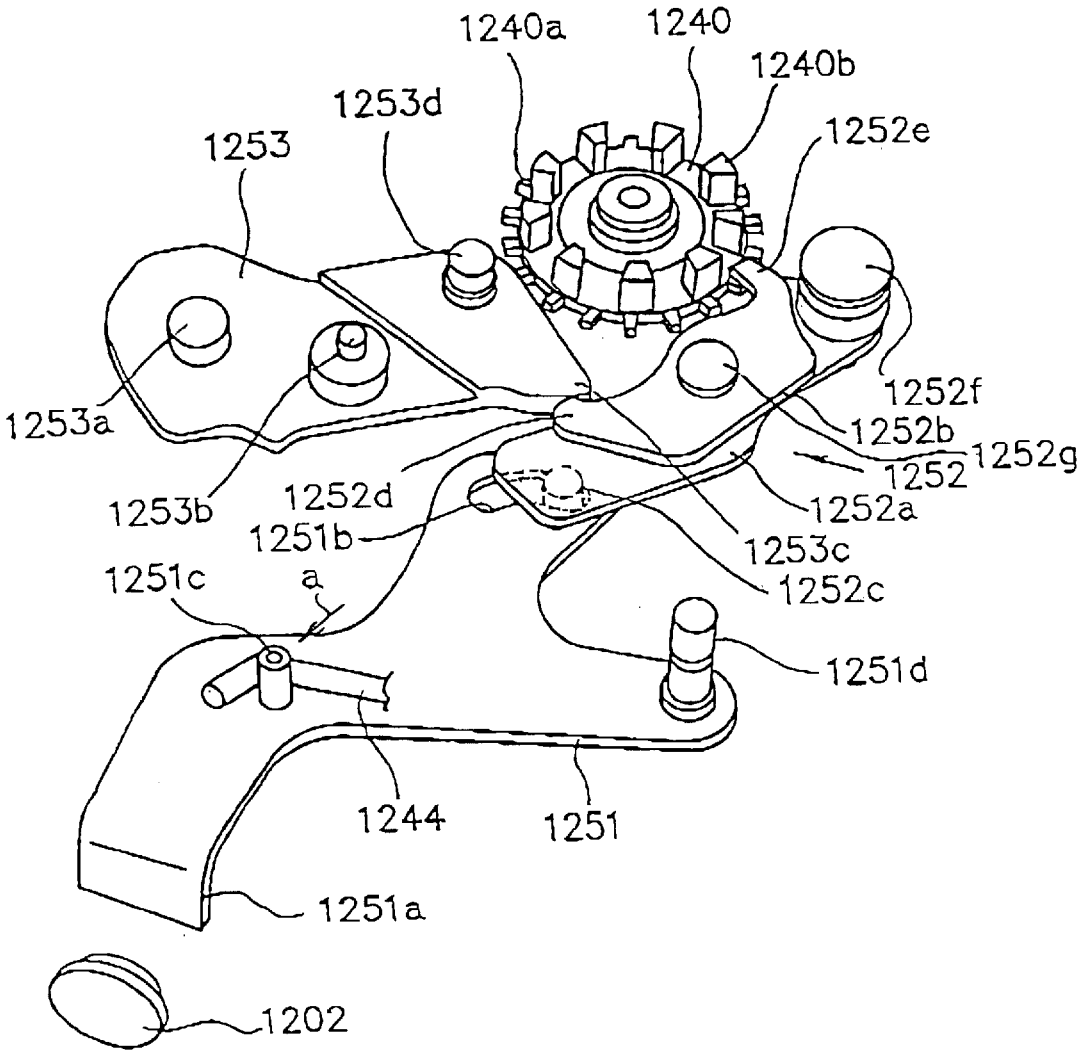
FIG. 10 is a first perspective view showing the operational example of a safety mechanism in the chronograph of FIG. 5.

When the chronograph section 1200 is in the start state, the operating lever 1251 is positioned as shown in FIG. 10 so that the pressure portion 1251*a* is detached from the reset button 1202, and the pin 1251*c* is urged under the elastic force of the operating lever spring 1244 in the direction of an arrow a as shown. The pressure portion 1252*e* of the second hammer operating lever member 1252*b* then stays out of the gap between columns 1240*b* of the operating cam 1240.

Figure 11:
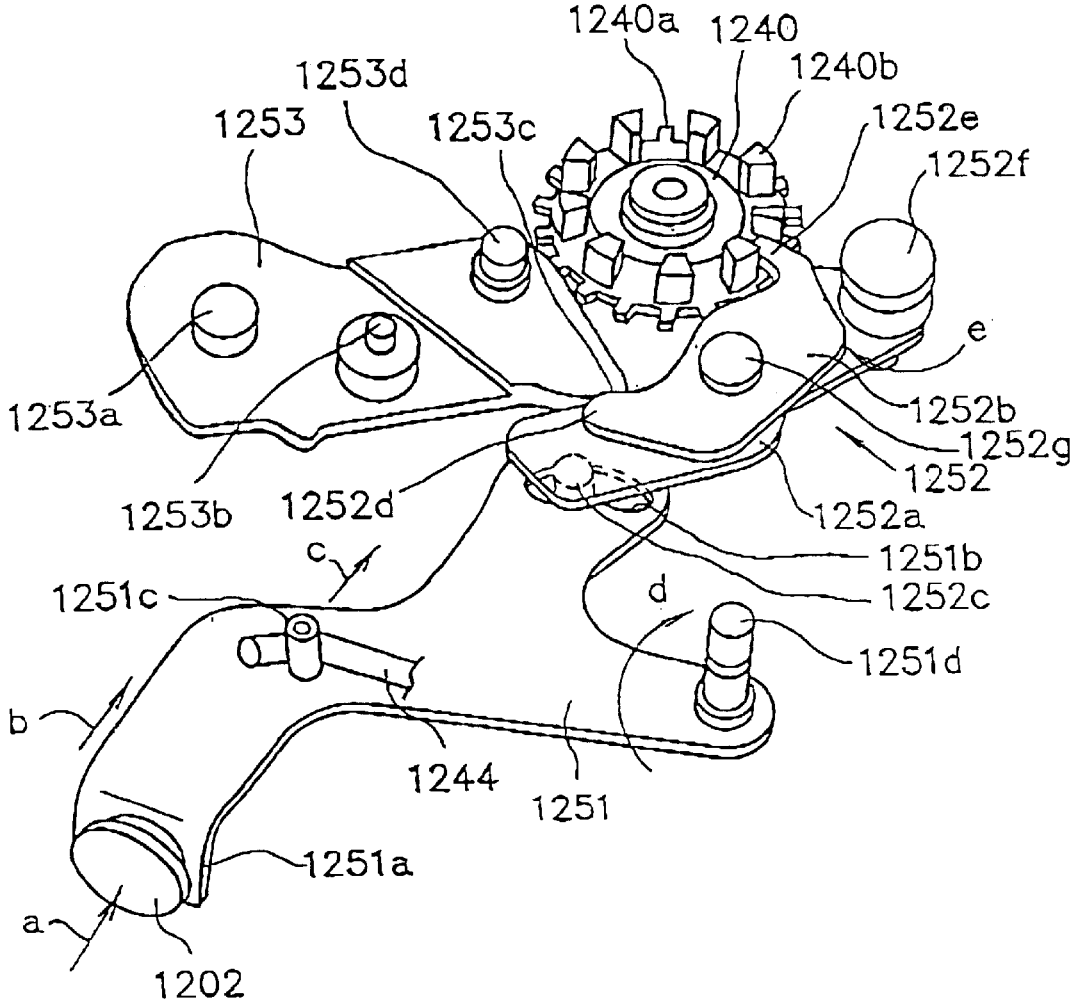
FIG. 11 is a second perspective view showing the operational example of the safety mechanism in the chronograph of FIG. 5.

When the reset button 1202 is pressed in the direction of an arrow a as shown in FIG. 11 in the above state, the reset button 1202 abuts and presses the pressure portion 1251*a* of the operating lever 1251 in the direction of an arrow b as shown, and the pin 1251*c* presses and elastically deforms the operating lever spring 1244 in the direction of an arrow c as shown. The entire operating lever 1251 pivots about the pin 1251*d* in the direction of an arrow d as shown. Along with its pivotal motion, the operating lever 1251 moves the pin 1252*c* of the first hammer operating lever member 1252*a* along the through hole 1251*b* of the operating lever 1251. The first hammer operating lever member 1252*a* thus pivots about the pin 1252*f* in the direction of an arrow e as shown.

Figure 12:
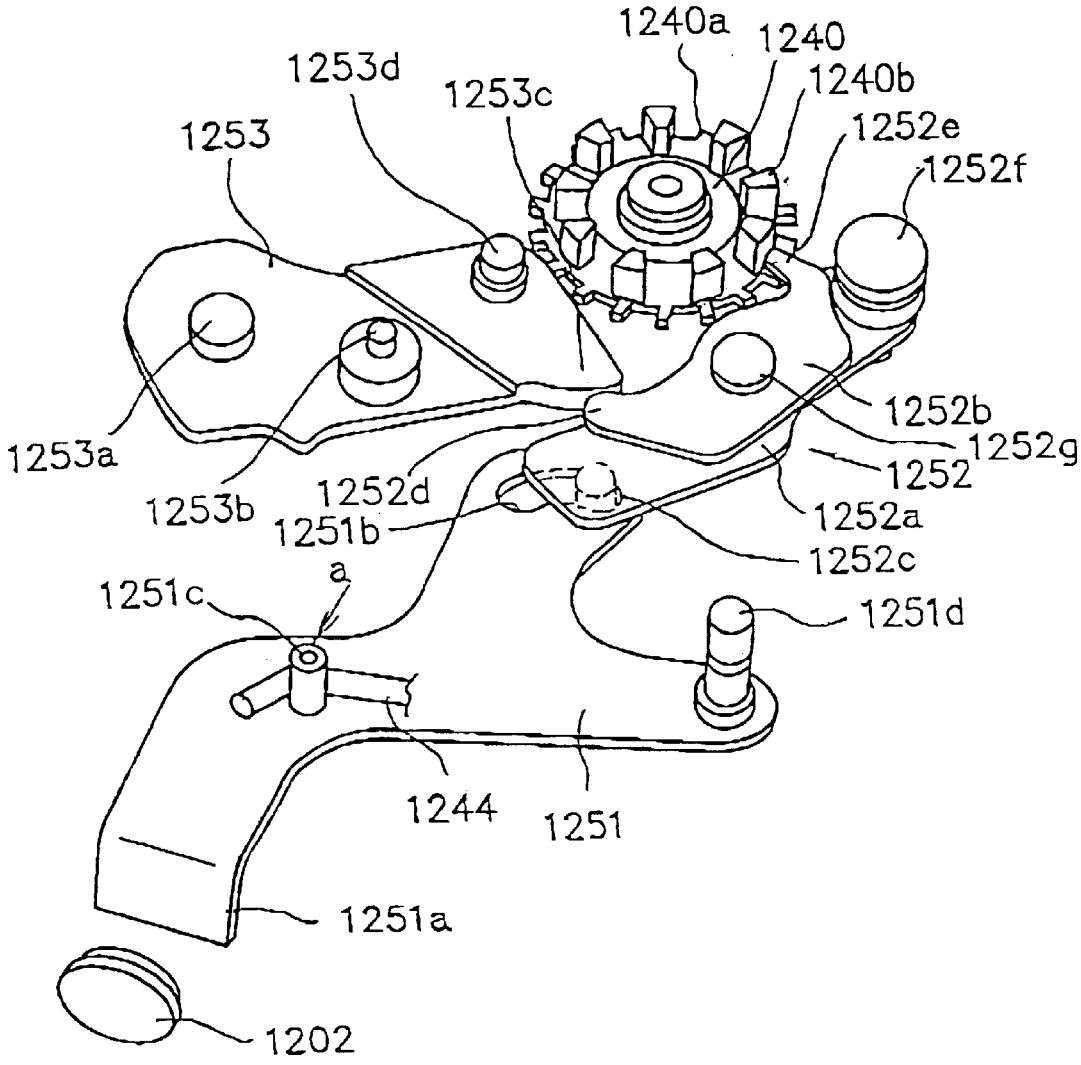
FIG. 12 is a third perspective view showing the operational example of the safety mechanism in the chronograph of FIG. 5.

Even if the pressure portion 1252*d* touches the pressure portion 1253*c* of the intermediate hammer 1253, the pressure portion 1253*c* is not pressed by the pressure portion 1252*d* because the pressure portion 1252*e* of the second hammer operating lever member 1252*b* enters the gap between columns 1240*b* of the operating cam 1240. The second hammer operating lever member 1252*b* pivots about the pin 1252*g*, thereby covering its own stroke without pressing the pressure portion 1253*c*. The force exerted onto the reset button 1202 is disconnected by the hammer operating lever 1252 and is not transmitted to the intermediate hammer 1253 to be described later and succeeding stages of the reset operating mechanism, and even if the reset button 1202 is erroneously pressed with the chronograph section 1200 under the start state, the chronograph section 1200 is prevented from being reset. When the chronograph section 1200 is in the stop state on the other hand, the operating lever 1251 is positioned as shown in FIG. 12 so that the pressure portion 1251*a* remains detached from the reset button 1202 and the pin 1251*c* is urged under the elastic force of the operating lever spring 1244 in the direction of an arrow a as shown. The pressure portion 1252*e* of the second hammer operating lever member 1252*b* is outside the area of the columns 1240*b* of the operating cam 1240.

Figure 13:
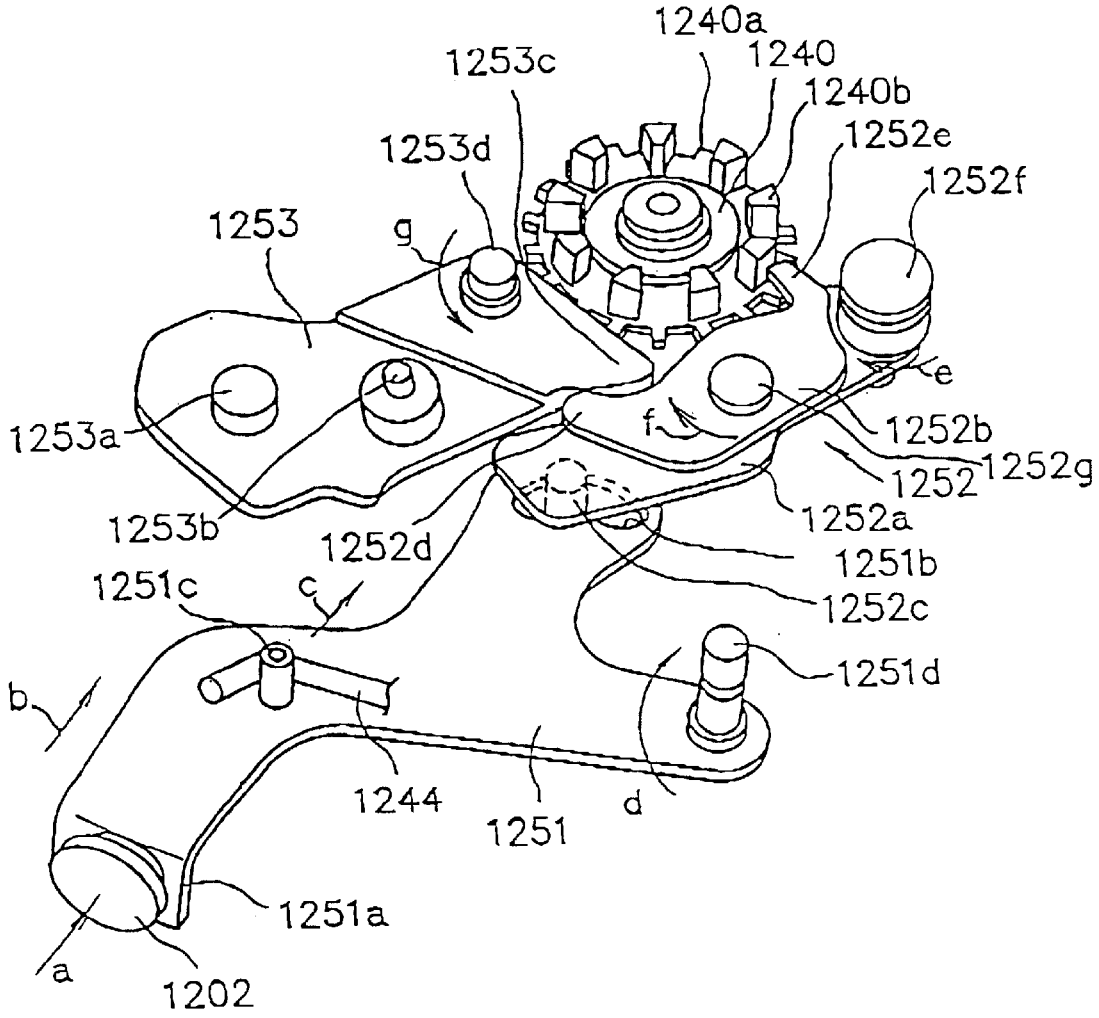
FIG. 13 is a fourth perspective view showing the operational example of the safety mechanism in the chronograph of FIG. 5.

When the reset button 1202 is manually pressed in the direction of an arrow a as shown in FIG. 13 in the above state, the reset button 1202 touches and presses the pressure portion 1251*a* of the operating lever 1251 in the direction of an arrow b as shown, and the pin 1251*c* presses and elastically deforms the operating lever spring 1244 in the direction of an arrow c as shown. The entire operating lever 1251 pivots about the pin 1251*d* in the direction of an arrow d as shown. Along with this pivotal motion, the operating lever 1251 moves the pin 1252*c* of the first hammer operating lever member 1252*a* along the through hole 1251*b*, thereby pivoting the first hammer operating lever member 1252*a* about the pin 1252*f* in the direction of an arrow e as shown.

Since the pressure portion 1252*e* of the second hammer operating lever member 1252*b* is then engaged with the side wall of the column 1240*b*, the second hammer operating lever member 1252*b* pivots about the pin 1252*g* in the direction of an arrow f as shown. Along with this pivotal motion, the pressure portion 1252*d* of the second hammer operating lever member 1252*b* touches and presses the pressure portion 1253*c* of the intermediate hammer 1253, thereby pivoting the intermediate hammer 1253 about the pin 1253*d* in the direction of an arrow g as shown. The force acting on the reset button 1202 is thus transmitted to the intermediate hammer 1253 and succeeding stages in the reset operating mechanism. The chronograph section 1200 is thus reset by pressing the reset button 1202 when the chronograph section 1200 is in the stop state. When the reset is activated, the contact point of the switch lever B 1257 is put into contact with a reset circuit of the circuit board 1704, electrically resetting the chronograph section 1200.

Figure 14:
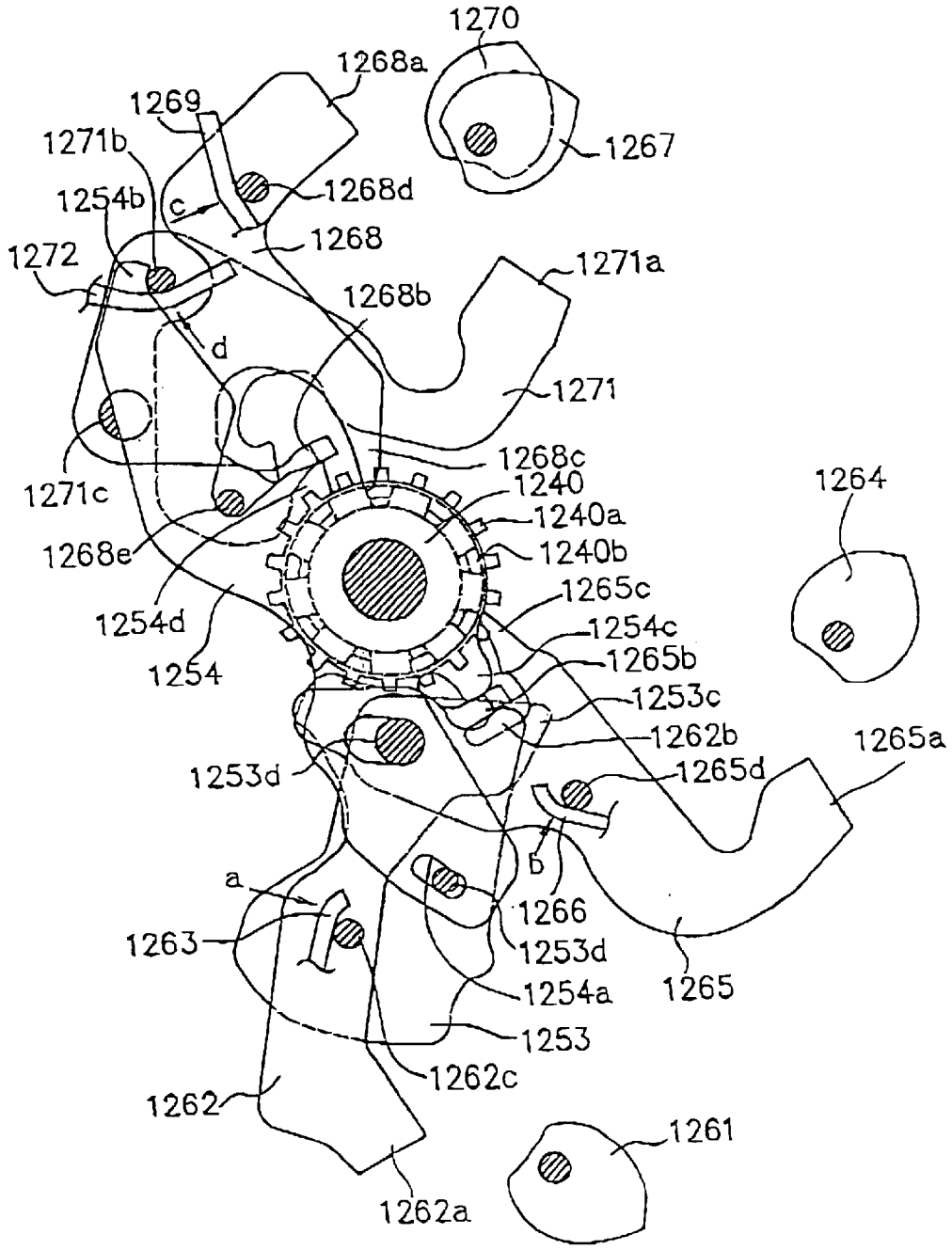
FIG. 14 is a first plan view showing the operational example of a major portion of a reset operating mechanism in the chronograph of FIG. 5.

Referring to FIG. 14, a major portion of the reset operating mechanism of the chronograph section 1200 shown in FIG. 5 is now discussed, which includes the hammer driving lever 1254, heart cam A 1261, zero reset lever A 1262, zero reset lever A spring 1263, heart cam B 1264, zero reset lever B 1265, zero reset lever B spring 1266, heart cam C 1267, zero reset lever C 1268, zero reset lever C spring 1269, heart cam D 1270, zero reset lever D 1271, and zero reset lever D spring 1272.

The hammer driving lever 1254, having a generally I-shape, planar structure, includes an elliptical through hole 1254*a* near one end, a lever D restraining portion 1254*b* on the other hand, and a lever B restraining portion 1254*c* and a lever C restraining portion 1254*d* in the center. The hammer driving lever 1254 is pivotally supported at its center, and constitutes the reset operating mechanism, in which the pin 1253*b* of the intermediate hammer 1253 is received within the through hole 1254*a*.

The heart cams A 1261, B 1264, C 1267, and D 1270 are respectively attached to the rotary shafts of the CG 1/10-second wheel 1232, CG second wheel 1223, CG minute wheel 1216, and CG hour wheel 1217.

The zero reset lever A 1262 has, on one end, a hammer portion 1262*a* for abutting the heart cam A 1261, a rotation setting portion 1262*b* on the other end, and a pin 1262*c* in the center. The zero reset lever A 1262 is pivotally supported by the pin 1253*d*, the other end of which is affixed to the movement. The zero reset lever A 1262 constitutes the reset operating mechanism, in which one end of the zero reset lever A spring 1263 is anchored at the pin 1262*c*.

The zero reset lever B 1265 has, on one end, a hammer portion 1265*a* for abutting the heart cam B 1264, a rotation setting portion 1265*b* and a pressure portion 1265*c* on the other end, and a pin 1265*d* in the center. The zero reset lever B 1265 is pivotally supported by the pin 1253*d*, the other end of which is affixed to the movement. The zero reset lever B 1265 constitutes the reset operating mechanism, in which one end of the zero reset lever B spring 1266 is anchored at the pin 1265*d*.

The zero reset lever C 1268 has, on one end, a hammer portion 1268*a* for abutting the heart cam C 1267, a rotation setting portion 1268*b* and a pressure portion 1268*c* on the other end, and a pin 1268*d* in the center. The zero reset lever C 1268 is pivotally supported at a pin 1268*e*, the other end of which is affixed to the movement. The zero reset lever C 1268 constitutes the reset operating mechanism, in which one end of the zero reset lever C spring 1269 is anchored at the pin 1268*d*.

The zero reset lever D 1271 has, on one end, a hammer portion 1271*a* for abutting the heart cam D 1270, and a pin 1271*b* on the other end. The zero reset lever D 1271 is pivotally supported at a pin 1271*c*, the other end of which is affixed to the movement. The zero reset lever D 1271 constitutes the reset operating mechanism, in which one end of the zero reset lever D spring 1272 is anchored at the pin 1271*b*.

Figure 15:
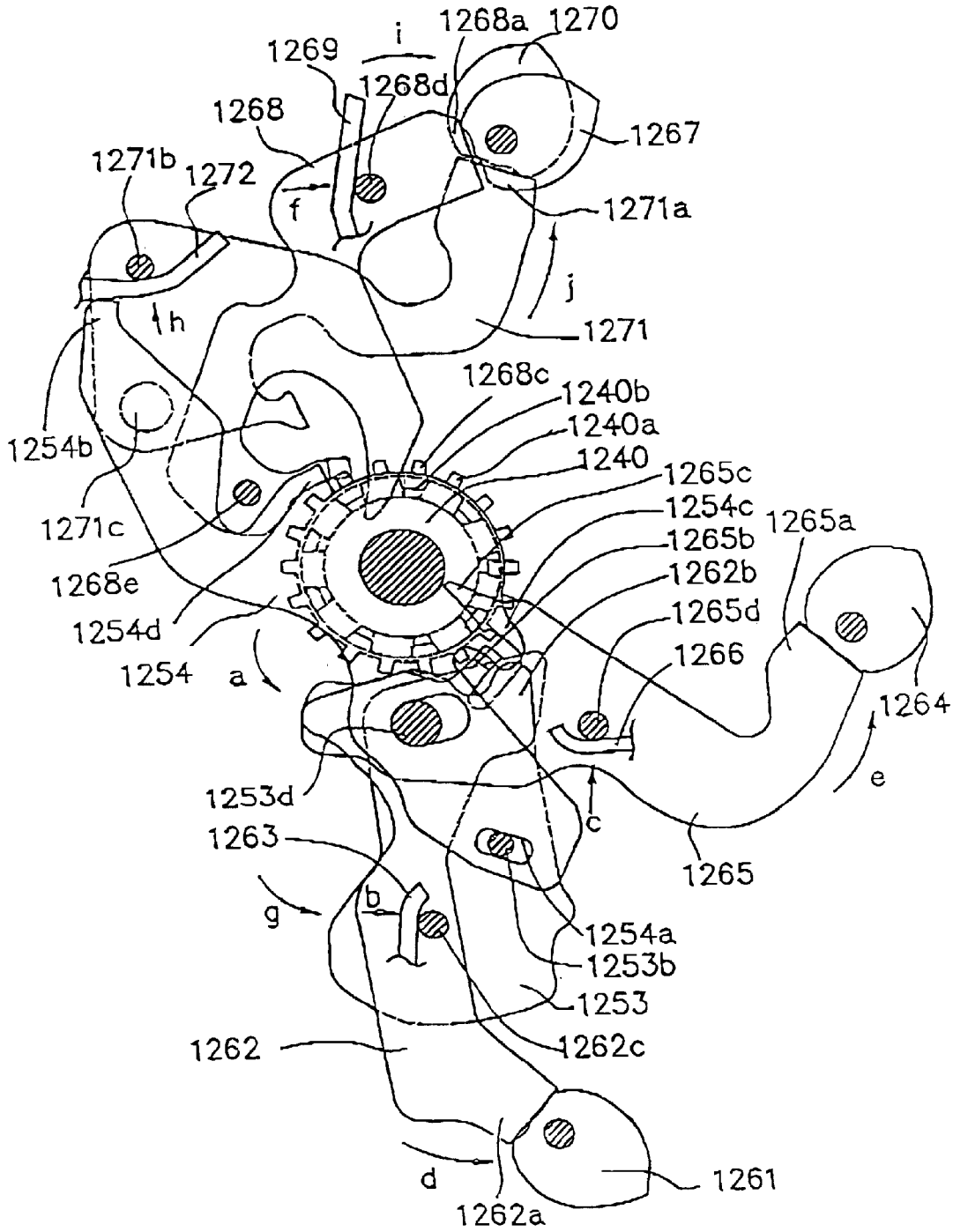
FIG. 15 is a second plan view showing the operational example of the major portion of the reset operating mechanism in the chronograph of FIG. 5.

The operation of the reset operating mechanism is now discussed, referring to FIG. 14 and FIG. 15.

When the chronograph section 1200 is in the stop state, the zero reset lever A 1262 is positioned as shown in FIG. 14 so that the rotation setting portion 1262*b* is engaged with the rotation setting portion 1265*b* of the zero reset lever B 1265, and the pin 1262*c* is urged under the elastic force of the zero reset lever A spring 1263 in the direction of an arrow a as shown.

The zero reset lever B 1265 is positioned so that the rotation setting portion 1265*b* is engaged with the lever B restraining portion 1254*c* of the hammer driving lever 1254, the pressure portion 1265*c* is pressed by the side wall of the column 1240*b* of the operating cam 1240, and the pin 1265*d* is urged under the elastic force of the zero reset lever B spring 1266 in the direction of an arrow b as shown.

The zero reset lever C 1268 is positioned so that the rotation setting portion 1268*b* is engaged with the lever C restraining portion 1254*d* of the hammer driving lever 1254, the pressure portion 1268*c* is pressed by the side wall of the column 1240*b* of the operating cam 1240, and the pin 1268*d* is urged under the elastic force of the zero reset lever C spring 1269 in the direction of an arrow c as shown.

The zero reset lever D 1271 is positioned so that the pin 1271*b* is engaged with the lever D restraining portion 1254*b* of the hammer driving lever 1254 while being urged under the elastic force of the zero reset lever D spring 1272 in the direction of an arrow d as shown.

The respective hammer portions 1262*a*, 1265*a*, 1268*a*, and 1271*a* of the zero reset levers A 1262, B 1265, C 1268, and D 1271 are positioned to be apart from the respective heart cams A 1261, B 1264, C 1267, and D 1270 by predetermined separations.

When the intermediate hammer 1253 pivots about the pin 1253*d* in the direction of an arrow g as shown in FIG. 13 in the above state, the pin 1253*b* of the intermediate hammer 1253 moves within the through hole 1254*a* of the hammer driving lever 1254 while pushing the edge of the through hole 1254*a*, and thereby the hammer driving lever 1254 pivots in the direction of an arrow a as shown in FIG. 15.

The rotation setting portion 1265*b* of the zero reset lever B 1265 is disengaged from the lever B restraining portion 1254*c* of the hammer driving lever 1254, and the pressure portion 1265*c* of the zero reset lever B 1265 is inserted into the gap between one column 1240*b* and another column 1240*b* of the operating cam 1240. The pin 1265*d* of the zero reset lever B 1265 is urged by the restoring force of the zero reset lever B spring 1266 in the direction of an arrow c as shown. The setting of the rotation setting portion 1262*b* is released, and the pin 1262*c* of the zero reset lever A 1262 is urged by the restoring force of the zero reset lever A spring 1263 in the direction of an arrow b as shown. The zero reset lever A 1262 and the zero reset lever B 1265 pivot respectively about the pin 1253*d* in the directions of arrows d and e as shown, and the hammer portions 1262*a* and 1265*a* respectively hit and rotate the heart cams A 1261 and B 1264, thereby resetting the intermediate CG 1/10-second wheel 1231 and the CG second wheel 1221 to zero.

At the same time, the rotation setting portion 1268*b* of the zero reset lever C 1268 is disengaged from the lever C restraining portion 1254*d* of the hammer driving lever 1254, the pressure portion 1268*c* of the zero reset lever C 1268 enters into the gap between one column 1240*b* and another column 1240*b* of the operating cam 1240, and the pin 1268*d* of the zero reset lever C 1268 is urged under the restoring force of the zero reset lever C spring 1269 in the direction of an arrow f as shown. Furthermore, the pin 1271*b* of the zero reset lever D 1271 is disengaged from the lever D restraining portion 1254*b* of the hammer driving lever 1254. In this way, the pin 1271*b* of the zero reset lever D 1271 is urged under the restoring force of the zero reset lever D spring 1272 in the direction of an arrow h as shown. The zero reset lever C 1268 and the zero reset lever D 1271 respectively pivot about the pin 1268*e* and pin 1271*c* in the directions of arrows i and j as shown. The hammer portion 1268*a* and hammer portion 1271*a* respectively hit and rotate the heart cams C 1267 and D 1270, resetting the hour and minute hands 1211 and 1212 to zero.

Through the above series of operational steps, the chronograph section 1200 is reset by pressing the reset button 1202 with the chronograph section 1200 in the stop state.

Figure 16:
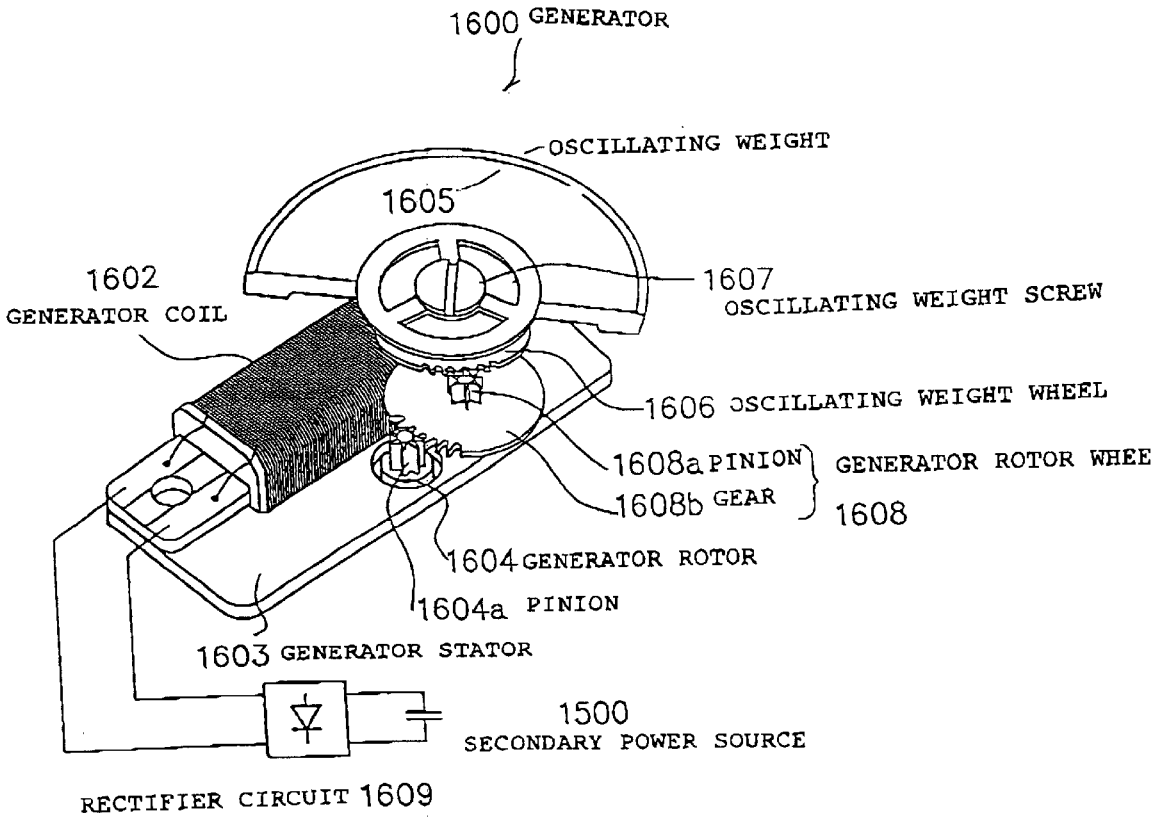
FIG. 16 is a perspective view roughly showing one example of a generator used in the electronic watch of FIG. 1.

FIG. 16 is a perspective view roughly showing a generator used in the electronic watch shown in FIG. 1.

The generator 1600 includes a generator coil 1602 wound around a high-permeability material, a generator stator 1603 constructed of a high-permeability material, a generator rotor 1604 composed of a permanent magnet and a pinion, an oscillating weight 1605 having a one-sided weight, etc.

The oscillating weight 1605 and an oscillating weight wheel 1606 arranged below the oscillating weight 1605 are rotatably supported about a shaft that is rigidly attached to an oscillating weight base. The oscillating weight 1605 and oscillating weight wheel 1606 are prevented from axially coming off with an oscillating weight screw 1607. The oscillating weight wheel 1606 is in mesh with a pinion 1608*a* of a generator rotor wheel 1608, and the pinion 1608*a* of the generator rotor wheel 1608 is in mesh with a pinion 1604*a* of the generator rotor 1604. These train wheels increase an input speed by 30 through 200 times. Such a speed increasing ratio may be optionally selected, depending on the performance of the generator and the specifications of the watch.

When the oscillating weight 1605 oscillates with the motion of the arm of a user, the generator rotor 1604 rotates fast. Since the permanent magnet is rigidly attached to the generator rotor 1604, the direction of a magnetic flux intersecting the generator coil 1602 through the generator stator 1603 changes each time the generator rotor 1604 turns, and an alternating current is generated in the generator coil 1602 by electromagnetic induction. The alternating current is rectified through a rectifier circuit 1609 and charges the secondary power source 1500.

FIG. 17 is a block diagram roughly showing the entire system of the electronic watch of FIG. 1 with the mechanical sections removed.

A signal, for example, a signal SQB of an oscillation frequency of 32 kHz, output from a crystal oscillator circuit 1801 including a tuning fork crystal oscillator 1703, is fed to a high-frequency frequency divider 1802, which in turn frequency-divides the signal SQB into a frequency within a range from 16 kHz to 128 Hz. A signal SHD, frequency-divided by the high-frequency frequency divider 1802, is input to a low-frequency frequency divider 1803, which in turn frequency-divides the input signal into a signal within a range of 64 Hz to 1/80 Hz. The oscillation frequency of the low-frequency frequency divider 1803 is resettable by a basic watch reset circuit 1804 connected to the low-frequency frequency divider 1803.

A signal SLD, frequency-divided by the low-frequency frequency divider 1803, is fed to a motor pulse generator circuit 1805 as a timing signal. When the frequency divided SLD signal is made active every second or every tenth second, a motor driving pulse and detecting pulse SPW for detecting motor rotation and the like are generated. The motor driving pulse SPW, generated in the motor pulse generator circuit 1805, is fed to the motor 1300 for the standard time display mechanism 1100 to drive it. At a timing different from this pulse SPW, the pulse SPW for detecting the motor rotation and the like is fed to a motor detector circuit 1806, which detects the external magnetic field of the motor 1300 and the rotation of the motor 1300. The external magnetic field signal and rotation signal SDW, detected by the motor detector circuit 1806, is fed back to the motor pulse generator circuit 1805.

An alternating current SAC, generated in the generator 1600, is fed to the rectifier circuit 1609 via a charging control circuit 1811, and is full-wave rectified into a direct current voltage SDC, which then charges the secondary power source 1500. A voltage SVB across both terminals of the secondary power source 1500 is detected by a voltage detector circuit 1812, continuously or as required. Depending on the fully or insufficiently charged state of the secondary power source 1500, the voltage detector circuit 1812 feeds a corresponding charging control command SFC to the charging control circuit 1811. In response to the charging control command SFC, the start and stop of the supply of the alternating current SAC, generated by the generator 1600, to the rectifier circuit 1609 is controlled.

The direct current voltage SDC, charging the secondary power source 1500, is fed to a voltage multiplication circuit 1813 having voltage multiplication capacitors 1813*a*, where the direct current voltage SDC is multiplied at a predetermined multiplication rate. The voltage multiplied direct current voltage SDU is stored in the high-capacitance capacitor 1814.

The voltage multiplication is carried out to ensure that the motors and circuits reliably operate even if the voltage of the secondary power source 1500 drops the operating voltage of the motors and circuits. In other words, the motors and circuits are together driven by electrical energy stored in the high-capacitance capacitor 1814. If the voltage across the secondary power source 1500 becomes large and approaches 1.3 V, the high-capacitance capacitor 1814 and the secondary power source 1500 are connected in parallel in operation.

The voltage SVC across both terminals of the high-capacitance capacitor 1814 is detected by the voltage detector circuit 1812, continuously or as required, and depending on the electricity remaining in the high-capacitance capacitor 1814, a voltage multiplication command SUC, corresponding to the remaining electricity, is supplied to a voltage multiplication control circuit 1815. The voltage multiplication rate SWC in the voltage multiplication circuit 1813 is controlled in accordance with the voltage multiplication command SUC. The voltage multiplication rate refers to a multiplication rate at which the voltage across the secondary power source 1500 is boosted and generated across the high-capacitance capacitor 1814, specifically, the rate of (voltage across the high-capacitance capacitor 1814)/(voltage across the secondary power source 1500) is controlled at a rate of 3-fold, 2-fold, 1.5-fold, or 1-fold.

A mode control circuit 1824 for controlling the mode in the chronograph section 1200 receives a start signal SST, a stop signal SSP, a reset signal SRT, and a split signal SLT, from a switch A 1821 associated with the start/stop button 1201, a switch B 1822 associated with the reset button 1202, and a switch C 1820 associated with a split button 1203. The switch A 1821 is provided with the switch lever A 1243 as a switch sustaining mechanism.

The signal SHD, frequency-divided by the high-frequency frequency divider 1802, is input to the mode control circuit 1824. The mode control circuit 1824 outputs a start/stop control signal SMC to a chronograph reference signal generator circuit 1825. The chronograph reference signal generator circuit 1825 outputs a 10-Hz reference signal STN, for example, to the mode control circuit 1824 in accordance with the start/stop control signal SMC. The mode control circuit 1824 generates and outputs a chronograph reference signal SCB and the like to a motor pulse generator circuit 1826 in response to the reference signal STN.

The chronograph reference signal SCB, generated in the mode control circuit 1824, is fed to a low-frequency frequency divider circuit 1827. A signal SCD, for example, within a range from 64 Hz to 16 Hz, frequency-divided by the low-frequency frequency divider circuit 1827, is input to a motor pulse generator circuit 1826.

The chronograph reference signal SCB and the frequency-divided signal SCD are fed to the motor pulse generator circuit 1826 as timing signals. For example, the frequency-divided signal SCD is made active in accordance with the output timing of 1/10-second or 1 second chronograph reference signal SCB, and based on the frequency-divided signal SCD and the like, the motor driving pulse and the pulse SPC for detecting the motor rotation and the like is generated. The motor driving pulse SPC, generated in the motor pulse generator circuit 1826, is fed to the motor 1400 in the chronograph section 1200 to drive it. At a timing different from that of the driving pulse SPC, the pulse SPC for detecting the motor rotation and the like is fed to a motor detector circuit 1828, which detects the external magnetic field of the motor 1400 and the rotation of the motor 1400. The external magnetic field signal and rotation signal SDG, detected by the motor detector circuit 1828, are fed back to the motor pulse generator circuit 1826.

When the stop signal SSP is input to the mode control circuit 1824, the output of the start/stop control signal SMC stops, and the generation of the chronograph reference signal SCB stops. The driving of the motor 1400 in the chronograph section 1200 is thus stopped. The reset signal SRT, which is input to the mode control circuit 1824 subsequent to the stop of the generation of the chronograph reference signal SCB, namely, subsequent to the stop of the generation of the start/stop control signal SMC to be described later, is input to the chronograph reference signal generator circuit 1825 as a reset control signal SRC. The chronograph reference signal generator circuit 1825 is thus reset, while each chronograph hand is also reset (to zero) in the chronograph section 1200.

Figure 18:
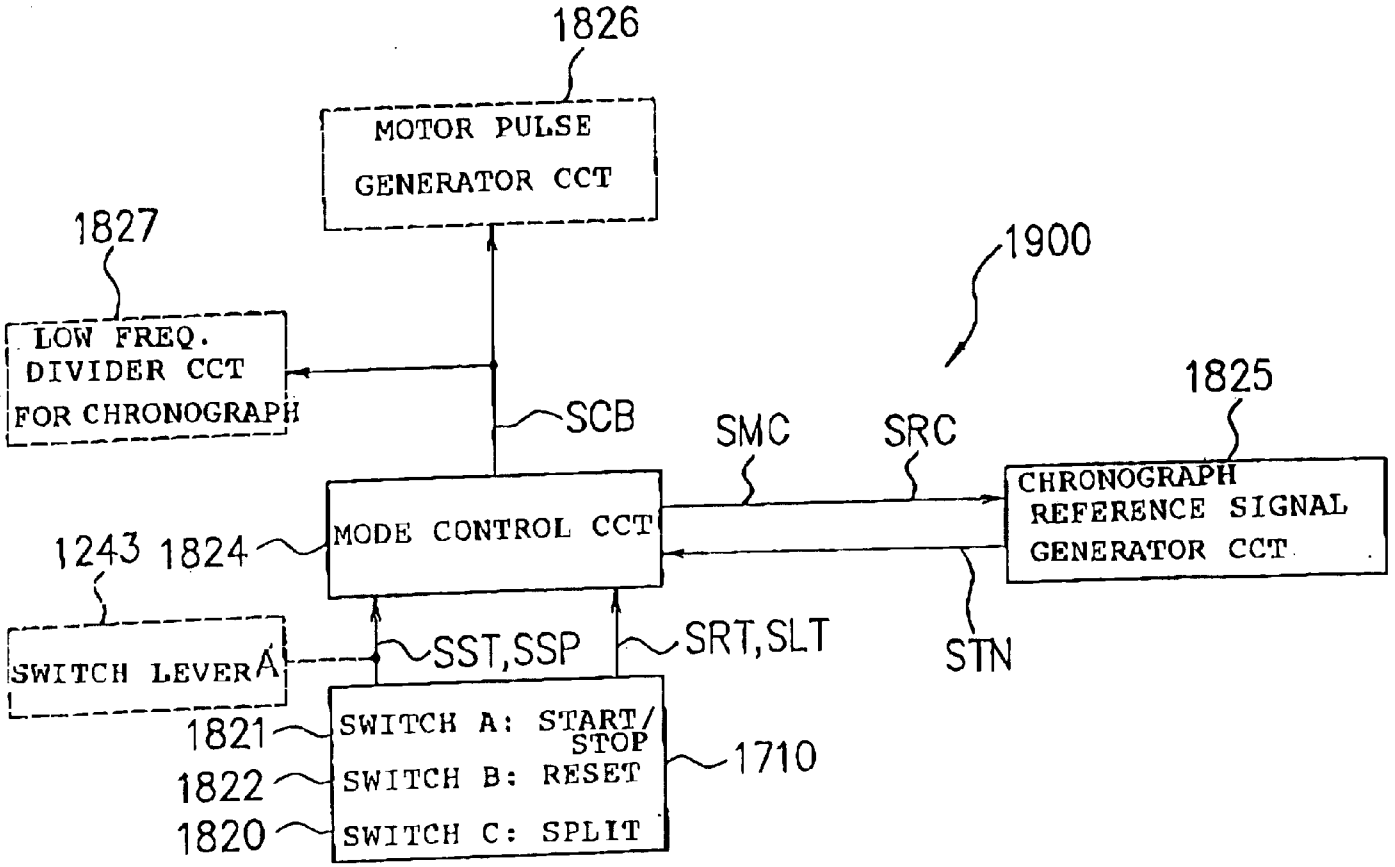
FIG. 18 is a block diagram showing the construction of a chronograph control unit and its associated section shown in FIG. 1.

FIG. 18 is a block diagram showing a chronograph control unit 1900 and its associated components shown in FIG. 1.

In the following discussion, a "measurement mode" refers to the state in which time measurement by the chronograph is in progress, a "split mode" refers to the state in which time measurement is temporarily suspended in the measurement mode, and a "stop mode" refers to the state in which time measurement is stopped.

The chronograph control unit 1900 (control unit) includes the mode control circuit 1824, the chronograph reference signal generator circuit 1825, etc.

A switch 1710 collectively refers to the start/stop switch (switch A) 1821 and the reset switch (switch B) 1822, respectively operated by the start/stop button 1201 and the reset button 1202, the split switch (switch C) 1820 operated by the split button 1203 shown in FIG. 2, and the like. The start/stop switch 1821 is turned on and off when the start/stop button 1201 is operated. The reset switch 1822 and the split switch 1820 respectively generate the reset signal SRT and the split signal SLT, in a one-shot pulse form (a signal that is transitioned from an L level to an H level and then transitioned from an H level back an H level) when the user operates the reset button 1202 and the split button 1203 shown in FIG. 2.

The start/stop switch 1821 is mechanically sustained in an on/off state by the switch lever A 1243 (switch sustaining mechanism). With the switch lever A 1243, the start/stop switch 1821 is turned on in response to a first operation, for example, and is turned off in response to a second operation. This is cycled each time the start/stop button 1201 is pressed.

The mode control circuit 1824 includes, for example, a circuit that detects through sampling that the start/stop button 1201 is held on or off by the switch lever A 1243. The mode control circuit 1824 also includes a chattering prevention circuit for preventing a chattering occurring at the operation of a switch from being recognized as the reset signal SRT or the split signal SLT.

The mode control circuit 1824 outputs, to the chronograph reference signal generator circuit 1825, the start/stop control signal SMC in response to the start signal SST or the stop signal SSP, and the reset control signal SRC in response to the reset signal SRT. The mode control circuit 1824 will be discussed in detail later.

The chronograph reference signal generator circuit 1825 outputs, to the mode control circuit 1824 shown in FIG. 17, a 10-Hz reference signal STN, for example, in response to the start/stop control signal SMC from the mode control circuit 1824. The mode control circuit 1824 outputs, to the motor pulse generator circuit 1826, the chronograph reference signal SCB in response to the reference signal STN or the like. The chronograph reference signal SCB is a signal for assuring timing of the motor pulse SPC that is output from the motor pulse generator circuit 1826 to the motor 1400.

Figure 19:
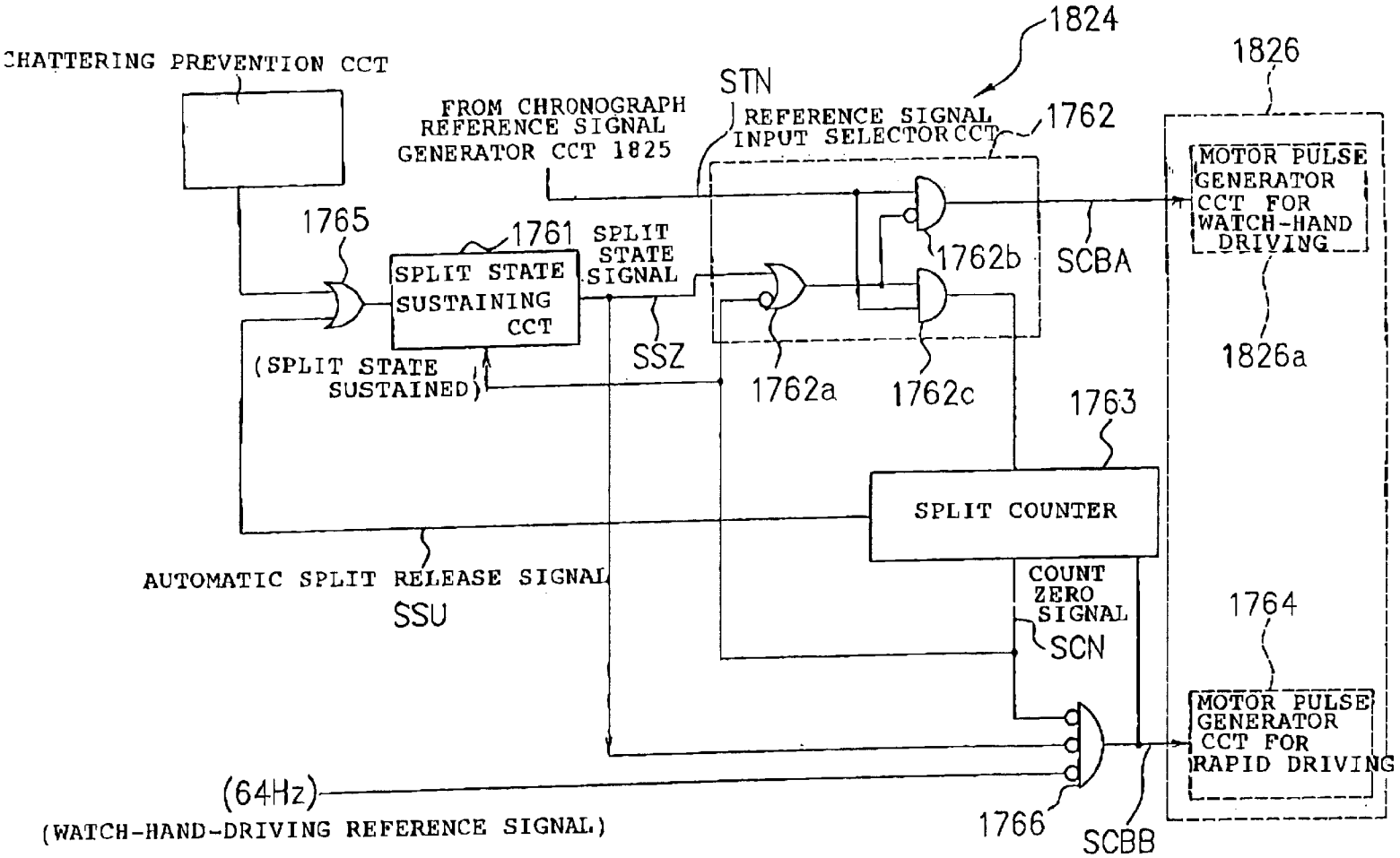
FIG. 19 is a circuit diagram showing part of a mode control circuit and its associated circuit shown in FIG. 18.

FIG. 19 is a block diagram of part of the mode control circuit 1824 and its associated circuit shown in FIG. 18 in connection with the slip operation.

The mode control circuit 1824 includes a split state sustaining circuit 1761 for the split operation, an OR gate 1765, a reference signal input selector circuit 1762, a split counter 1763 (release unit), an AND gate 1766, etc. The mode control circuit 1824 is connected to a watch-hand driving pulse generator circuit 1826*a* and a rapid driving pulse generator circuit 1764 shown in FIG. 17, forming part of the motor pulse generator circuit 1826.

The split state sustaining circuit 1761 is connected to the reference signal input selector circuit 1762, split counter 1763, OR gate 1765, etc.

Input to the split state sustaining circuit 1761 is a one-shot pulse from the split switch 1820 through the mode control circuit 1824 and the OR gate 1765. In response to the input from the OR gate 1765, the split state sustaining circuit 1761 outputs, to the reference signal input selector circuit 1762 and the AND gate 1766, a split state signal SSZ indicating whether the split state is entered. The split state signal SSZ remains at an L level when the watch is not in the split state with the split switch 1820 not operated, but is driven to an H level when the split switch 1820 is operated for the split state (after a chattering prevention period).

Figure 22:
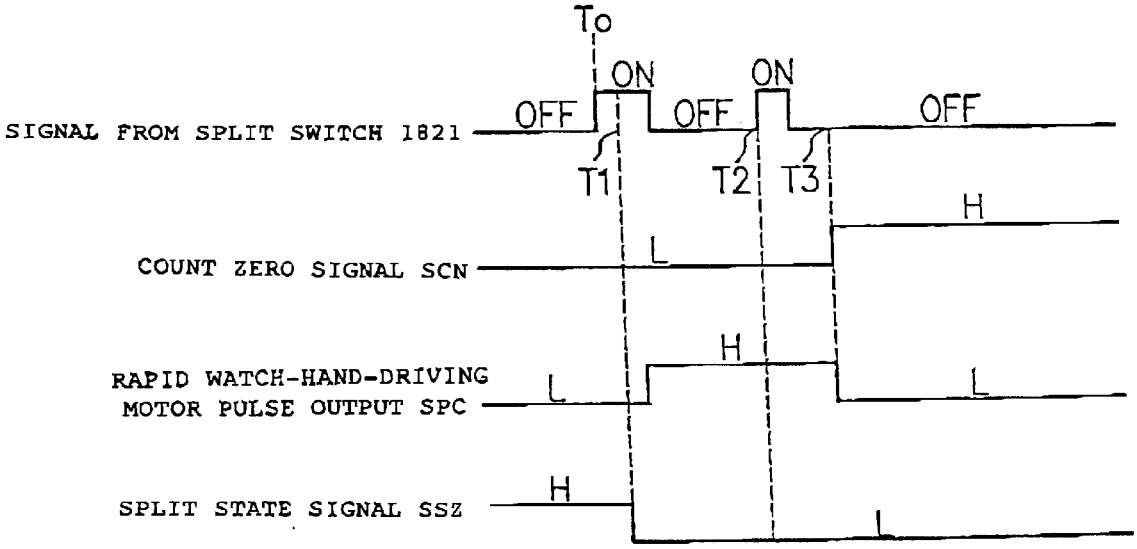
FIG. 22 is a timing diagram of signals when a split operation is activated again in watch hand subsequent to the release of the split operation.

Even if the user presses the split button 1203 in the middle of watch hand following action (for reverting each watch hand to time measurement position) in the chronograph section 1200 after releasing the split state by pressing the split switch 1820, a re-split step is prevented by performing the operation shown in FIG. 22.

At time T0, a one-shot pulse is generated in response to the pressing of the split switch 1820. The split state is released at time T1 after the chattering prevention period in succession to time T0. When the split state is released, the watch hand following motor pulse SPC is output in synchronization with the hand driving reference signal. A count 0 signal SCN causes the split state signal SSZ to remain at an L level. Even if the split is activated again by pressing the split switch 1820 at time 2, the split is not accepted because the count 0 signal SCN continues to drive the split state signal SSZ to an L level.

The reference signal input selector circuit 1762 is connected to the watch-hand driving pulse generator circuit 1826*a*, split counter 1763, split state sustaining circuit 1761, chronograph reference signal generator circuit 1825 shown in FIG. 17, etc. The reference signal input selector circuit 1762 includes the OR gate 1762*a* and two AND gates 1762*b* and 1762*c*, etc. The reference signal input selector circuit 1762 gives its output to either the split counter 1763 or the watch-hand driving pulse generator circuit 1826*a*, depending on whether the reference signal STN from the chronograph reference signal generator circuit 1825 is in the split state or watch hand following state subsequent to the split release (from the input to the OR gate 1762*a*).

The split counter 1763 is connected to the reference signal input selector circuit 1762, split state sustaining circuit 1761, OR gate 1765, AND gate 1766, rapid driving pulse generator circuit 1765, etc. The split counter 1763 counts up in response to the 10-Hz reference signal STN generated by the chronograph reference signal generator circuit 1825. When a split is activated in the middle of time measurement, the split counter 1763 counts the signal that is output as the watch-hand driving chronograph reference signal SCBA (namely, the number of motor pulses determined by the signal SCBA) which is originally expected to output to the watch-hand driving pulse generator circuit 1826*a* throughout a duration of time from the split activation to the split release (if no split is commanded).

When the split is released, a rapid driving chronograph reference signal SCBB, corresponding to the count provided by the split counter 1763, is output to the rapid driving pulse generator circuit 1764 so that the watch hands are advanced to their originally expected positions.

After counting up for a predetermined duration of time, for example, for one minute, the split counter 1763 outputs, to the split state sustaining circuit 1761 via the OR gate 1765, an automatic split release signal SSU for releasing the split state.

The AND gate 1766 receives, for example, a 64-Hz pulse signal (watch-hand driving signal) that is obtained by frequency-dividing the clock signal from the highfrequency frequency divider 1802 shown in FIG. 17, the output signal from the split state sustaining circuit 1761, and the count 0 signal SCN from the split counter 1763. The AND gate 1766 outputs the rapid driving chronograph reference signal SCBB to the rapid driving pulse generator circuit 1764 and the split counter 1763. Specifically, when the split state is released, the AND gate 1766 outputs the rapid driving chronograph reference signal SCBB to the rapid driving pulse generator circuit 1764, thereby rapidly advancing the watch hands in the chronograph section 1200. Also, the output signal of the AND gate 1766 causes the split counter 1763 to count down.

Assuring timing in synchronization with the chronograph reference signal SCBA from the reference signal input selector circuit 1762, the watch-hand driving pulse generator circuit 1826*a* generates the standard driving motor pulse SPC for driving the watch hands in the chronograph section 1200 in the normal driving. The rapid driving pulse generator circuit 1764 generates the rapid driving motor pulse SPC in accordance with the rapid driving chronograph reference signal SCBB.

Figure 20:
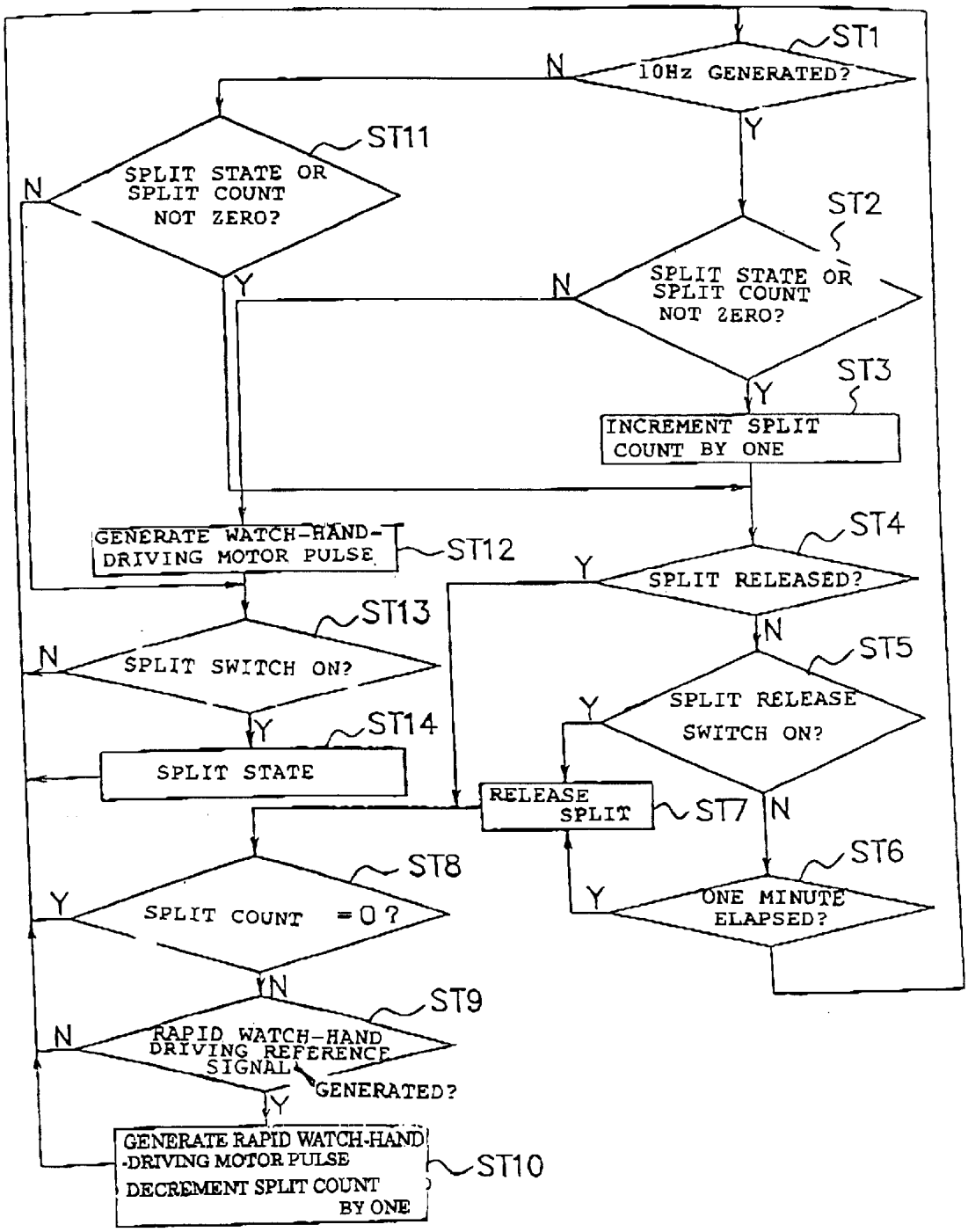
FIG. 20 is a flow diagram showing one example of automatic split release process performed by the mode control circuit shown in FIG. 19.

FIG. 20 is a flow diagram showing the automatic split release process in the electronic watch 1000.

When the split button 1203 is pressed in the measurement mode, the following split process is carried out.

The chronograph reference signal generator circuit 1825 frequency-divides a 128-Hz chronograph reference signal SCB at a ratio of divide-by-12 or divide-by-13, thereby outputting a 10-Hz reference signal STN to the mode control circuit 1824 (step ST1). When the reference signal STN is not generated, the process to be taken will be discussed later. A determination is made of whether the split mode is entered (step ST2). When it is determined that the watch is in the split mode or the split count is not zero, the split counter 1763 counts the reference signal STN, thereby incrementing its count by +1 (step ST3).

When the split is released (step ST4), the process goes to step ST8. When the split is not released (step ST4), a determination is made of whether the split switch 1820 is on or off (step ST5). When the split switch 1820 is on, the split is released, and the process goes to step ST8. When the split switch 1820 is off, a determination is made of whether one minute has elapsed (step ST6). When one minute has not elapsed, the process returns to step ST1. When one minute has elapsed, the signal SSU, indicating the elapsed time of one minute, is input to the OR gate 1765. In this way, the output SSZ of the split state sustaining circuit 1761 is driven to an L level, and the split state is released (step ST7).

After the split is released, a determination is made of whether the count at the split counter 1763 is zero (step ST8). When the count is zero, the process returns to step ST1. When the count is not zero, the rapid driving chronograph reference signal SCBB is output to the rapid driving pulse generator circuit 1764 via the AND gate 1766, causing the split counter 1763 to count down, decrementing its count by −1 (steps ST9 and ST10).

When the reference signal STN is not generated in step ST1, a determination is made of whether the split mode is entered (step ST11). When it is determined that the watch is in the split mode, the process goes to step ST4. When it is determined that the watch is not in the split mode, the process goes to the above-described step ST13 to determine whether the split switch 1820 is on or off.

When it is determined in step ST2 that the split mode is not entered, the motor pulse SPC is generated (step ST12), and the process goes to the above-described step ST13.

Figure 21:
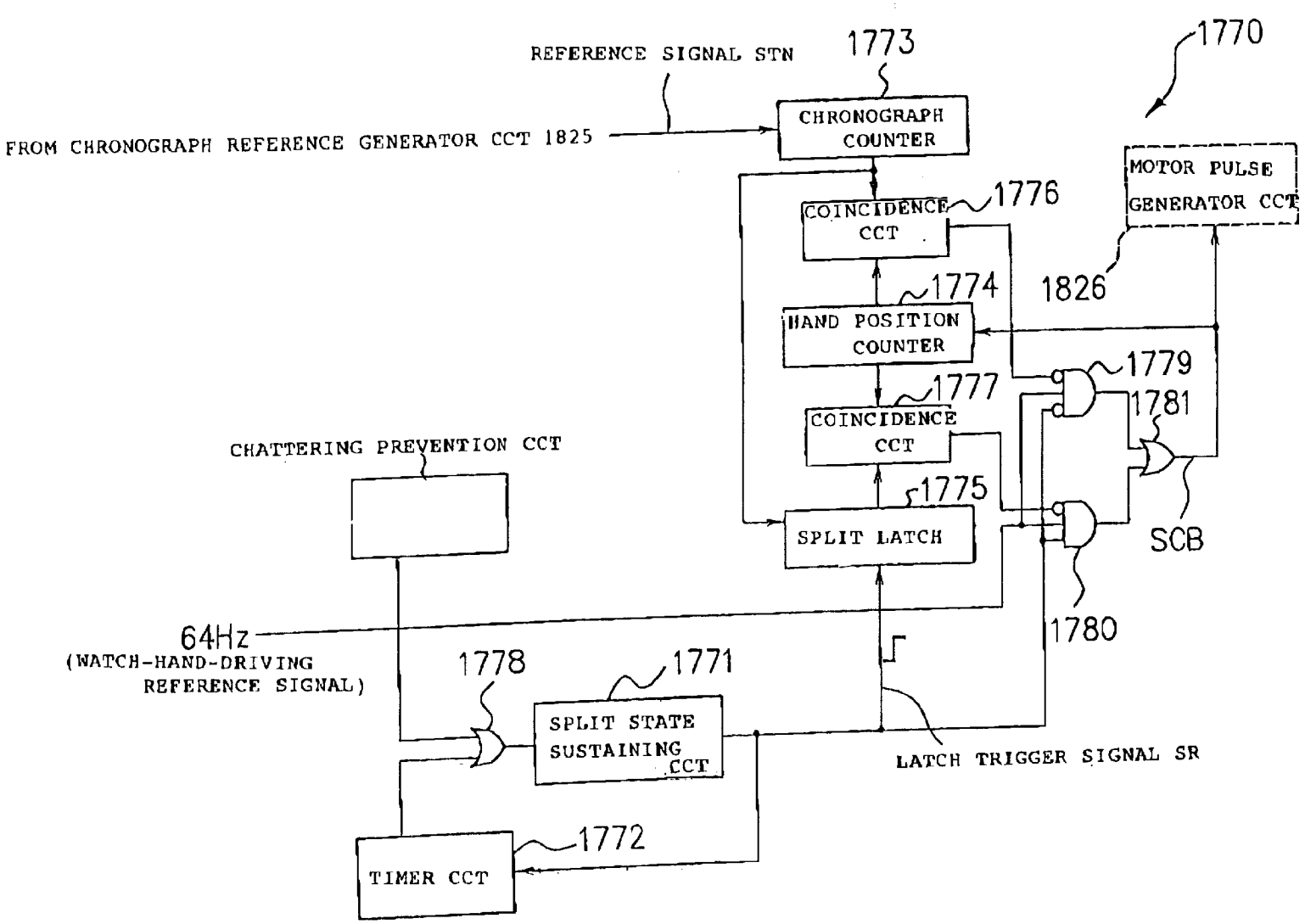
FIG. 21 is a circuit diagram showing another example of part of the mode control circuit and its associated circuit for a split operation.

FIG. 21 is a circuit diagram showing another example of part of the mode control circuit and its associated circuit for the split operation.

The mode control circuit 1824 includes an OR gate 1778, a split state sustaining circuit 1771, a timer circuit 1772 (a release unit), a chronograph counter 1773, a hand position counter 1774, a split latch 1775, coincidence circuits 1776 and 1777, AND gates 1779 and 1780, an OR gate 1781, etc. and the mode control circuit 1824 is connected to the motor pulse generator circuit 1826, the chronograph reference signal generator circuit 1825, etc.

The split state sustaining circuit 1771 is connected to the OR gate 1778, timer circuit 1772, split latch 1775, AND circuit 1780, etc.

The split state sustaining circuit 1771 latches the count of the chronograph counter 1773 to the split latch 1775 in response to the input to the OR gate 1778, and selects between the AND gate 1779 and the AND circuit 1780 to output a signal for assuring timing for outputting the motor pulse SPC.

The timer circuit 1772 is a 6-bit (60 seconds=111100 BIN) counter if it is a timer for measuring one minute according to the unit of one second. When a split state signal is input to the split state sustaining circuit 1771, the timer circuit 1772 puts the watch into the split release state by inputting a predetermined signal to the split state sustaining circuit 1771 via the OR gate 1778 after a time elapse of one minute.

The chronograph counter 1773 is connected to the chronograph reference signal generator circuit 1825, coincidence circuit 1776, split latch 1775, etc. The chronograph counter 1773 is a 19-bit counter. The chronograph counter 1773 is a counter for counting the 10-Hz reference signal STN coming in from the chronograph reference signal generator circuit 1825. The chronograph reference signal generator circuit 1825 outputs the reference signal STN even during the split mode. The chronograph counter 1773 therefore counts up even during the split mode.

The hand position counter 1774 is connected to the motor pulse generator circuit 1826, coincidence circuit 1776, coincidence circuit 1777, etc. The hand position counter 1774 counts the chronograph reference signal SCB the OR gate 1781 outputs to measure timing for outputting the motor pulse SPC. The hand position counter 1774 recognizes the watch hand position of each watch hand in the chronograph section 1200 by counting up the chronograph reference signal SCB which is output to the motor pulse generator circuit 1826 from the OR gate 1781. The hand position counter is a 19-bit counter, for example.

The split latch 1775 is connected to the coincidence circuit 1777, chronograph counter 1773, split state sustaining circuit 1771, etc. The split latch 1775 latches the count of the chronograph counter 1773 at the timing the input signal from the split state sustaining circuit 1771 is transitioned from an L level to an H level, namely, at the timing the standard time measurement state is changed to the split state. In other words, the count of the chronograph counter 1773 is latched in the split latch 1775 only when a latch trigger signal SR is input at the moment the split mode is entered.

The coincidence circuit 1776 is connected to the AND gate 1779, chronograph counter 1773, and hand position counter 1774. The coincidence circuit 1776 is used to perform the standard watch hand driving (including a rapid driving immediately subsequent to the release of the split state) in the chronograph. The coincidence circuit 1776 compares the count at the chronograph counter 1773 with the count at the hand position counter 1774, and outputs the result to the AND gate 1779.

The coincidence circuit 1777 is connected to the AND circuit 1780, split latch 1775, and hand position counter 1774. The coincidence circuit 1777 is used to advance the watch hands to their positions in split time during the split state. The coincidence circuit 1777 compares the value at the split latch 1775 with the count at the hand position counter 1774, and outputs the result to the AND gate 1780.

A 60-Hz pulse signal, which is obtained by frequency-dividing the clock signal from the high-frequency frequency divider 1802 shown in FIG. 17, is respectively fed to the AND gates 1779 and 1780.

The output signals of the AND gates 1779 and 1780 are fed to the OR gate 1781. The output of the OR gate 1781 is then sent to the motor pulse generator circuit 1826, etc. In this way, the motor pulse generator circuit 1826 generates the motor pulse SPC in accordance with the chronograph reference signal SCB from the OR gate 1781, thereby driving the motor 1400 shown in FIG. 17. The watch hand driving reference signal refers to a signal that is used as a reference signal for operating the motor 1400 for driving watch hands.

Figure 23:
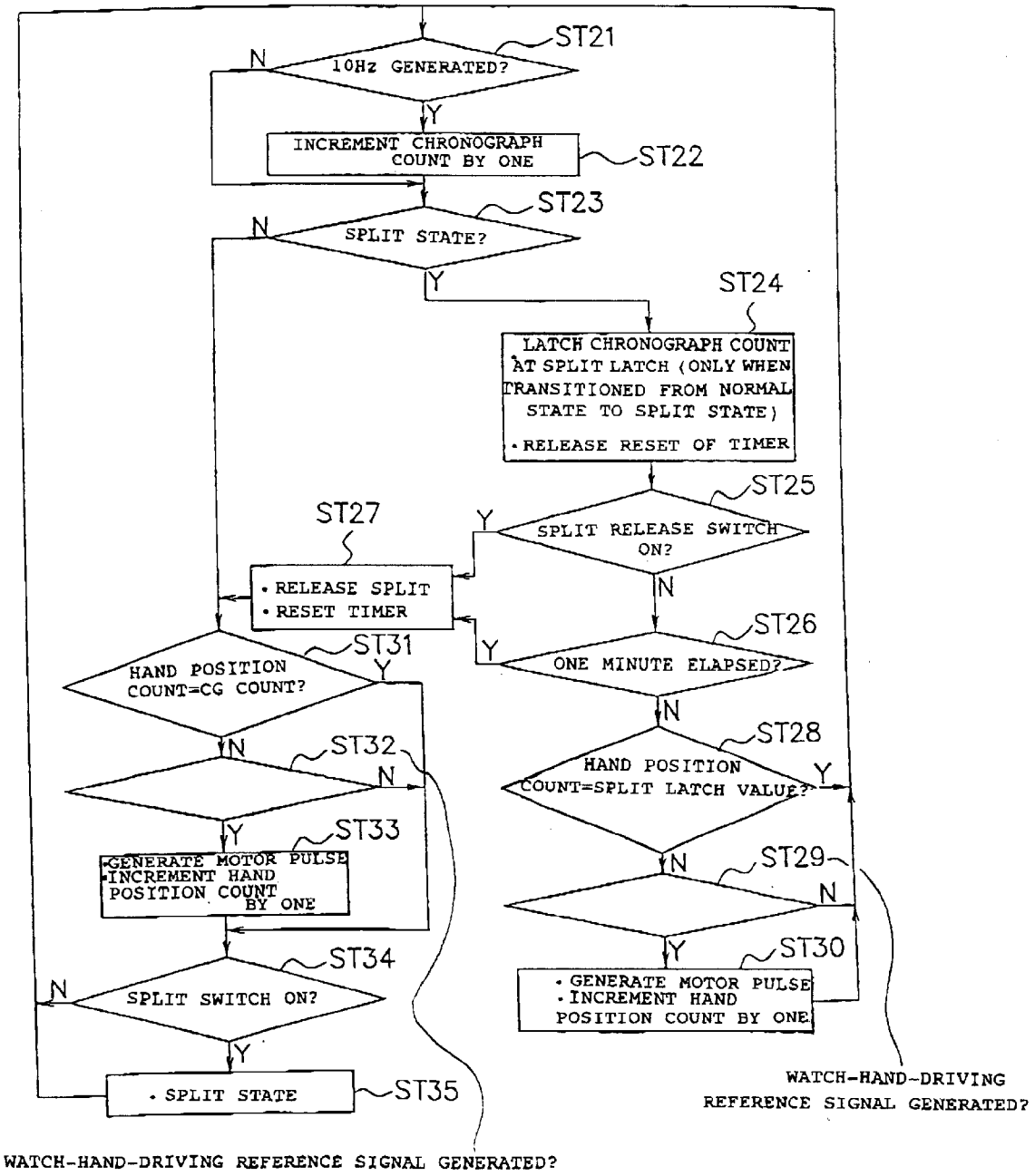
FIG. 23 is a flow diagram showing one example of another automatic split release process performed by the mode control circuit shown in FIG. 21.

FIG. 23 is a flow diagram showing an automatic split release process performed in the electronic watch 1000.

When the split button 1203 is pressed in the measurement mode, the split is performed as discussed below.

The chronograph reference signal generator circuit 1825 frequency-divides a 128-Hz start/stop control signal SMC at a ratio of divide-by-12 or divide-by-13, thereby outputting a 10-Hz reference signal STN to the mode control circuit 1824 (step ST21). The chronograph counter 1773 counts the reference signal STN, thereby incrementing its count by +1 (step ST22). A determination is made of whether the split mode is entered (step ST23).

When it is determined in step ST23 that the watch is in the split mode, the split latch 1775 latches the count at the chronograph counter 1773 (step ST24). At the same time, the resetting of the timer circuit 1772 is released, and a measurement of one minute, for example, starts.

When the split switch 1820 remains off (step ST25), the timer circuit 1772 outputs a signal after a time elapse of one minute (step ST26), for example. When the split switch 1820 is on (step ST25), the split switch 1820 outputs a signal to the split state sustaining circuit 1771, thereby releasing the split and resetting the timer circuit 1772 at the same time (step ST27).

When one minute has not elapsed in step ST26 (namely, still in the split state), the coincidence circuit 1777 compares the count at the hand position counter 1774 with the value at the split latch 1775 (step ST28).

When no coincidence is reached, the motor pulse generator circuit 1826 generates the motor pulse SPC in synchronization with the watch hand driving reference signal (step ST29), and the hand position counter 1774 counts up, incrementing its count by +1 (step ST30).

When a coincidence is reached in step ST28, the process returns to step ST21.

When it is determined in step ST23 that no split mode is entered, or when the split release is performed in step ST27, the coincidence circuit 1776 compares the watch hand count at the hand position counter 1774 with the chronograph count at the chronograph counter 1773 (step ST31).

When no coincidence is reached, the motor pulse generator circuit 1826 receives the watch hand driving reference signal (of 64 Hz, for example) shown in FIG. 21 (step ST32) and generates the motor pulse SPC, and the hand position counter 1774 counts up, incrementing its count by +1 (step ST33). When the split state is released, a rapid watch-hand driving is performed in response to the watchhand driving reference signal (of 64 Hz, for example) with the coincidence circuit 1776 providing a non-coincidence output until the coincidence circuit 1776 reaches a coincidence. When the coincidence circuit 1776 reaches a coincidence, the rapid watch-hand driving ends. The chronograph counter 1773 counts up every 1/10 second in accordance with the 10-Hz reference signal STN from the chronograph reference signal generator circuit 1825, as shown in FIG. 21. Since the coincidence circuit 1776 then gives a non-coincidence output, the chronograph reference signal SCB is generated in synchronization with the watch-hand driving reference signal (of 64 Hz, for example), and the motor pulse generator circuit 1826 generates the motor pulse SPC (as the hand position counter 1774 counts, the coincidence circuit 1776 reaches a coincidence). When a coincidence is reached in step ST31, or when the watch-hand driving reference signal is not generated in step ST32, a determination is made of whether the split switch 1820 is on or off (step ST34). When the split switch 1820 is on, the split state sustaining circuit 1771 is set to the split state, and when the split switch 1820 is off, the process goes to step ST21.

In accordance with the present invention, after a predetermined amount of time elapses in the split mode, the mode control circuit force releases the split mode, and the watch hands in the chronograph section are advanced to actual measurement time to assume again the standard watch hand motion. Even when the user forgets the watch in the split mode, the split mode is automatically released after the predetermined amount of time. Each watch hand follows the standard watch hand motion in the chronograph. Particularly, when the watch hands are driven by a single motor in the chronograph, a long time following operation of the watch hands subsequent to the split release is avoided, and a large power consumption of the battery is avoided. When the user uses such a time measurement device, the time measurement device, even in its split mode, is automatically released from the split mode after the predetermined amount of time passes, and this arrangement saves the user the time for releasing the split mode.

The present invention is not limited to the above embodiment, and a variety of modifications is possible without departing from the scope of the claims.

Although the time measurement has been discussed in conjunction with the electronic watch, the present invention is not limited to the electronic watch, and may be applied to a portable watch, a table clock, a wristwatch, a wall clock, etc.

Although the above embodiment has been discussed in connection with the secondary battery charged by the generator, as a source battery for the electronic watch, the present invention is not limited to this. Alternatively, a power source battery such as a conventional button battery, a solar cell or the like may be used instead of or along with the secondary battery.

Industrial Applicability

The present invention is particularly useful for use in a multi-function time measurement device having watch hands and a time measurement method.

What is claimed is:

1. A time measurement device, comprising:

a standard time measuring unit; and an elapsed time measuring unit including a split controlling unit and a time indicator hand;

wherein the split controlling unit is adapted to temporarily suspend movement of the time indicator hand, during measurement of elapsed time, such that after a predetermined amount of time passes from the time that the time indicator hand is initially temporarily suspended, the split controlling unit automatically releases temporary suspension of the time indicator hand and causes the time indicator hand to be rapidly driven to a position indicating the elapsed time;

the elapsed time measuring unit further comprising a first measuring unit that determines a position where the time indicator hand would be if its movement had not been temporarily suspended;

a second measuring unit that determines a temporarily suspended position of the time indicator hand;

a release unit that releases temporary suspension of the time indicator hand after the predetermined amount of time;

a comparator that compares the position of the time indicator hand determined by the first measuring unit and the position of the time indicator hand determined by the second measuring unit; and a time-indicator-hand driving unit that rapidly drives the time indicator hand based on the comparison result generated by the comparator, when the release unit releases temporary suspension of the time indicator hand.

2. A time measurement device according to claim 1, wherein the elapsed time measuring unit further comprises a measuring unit that measures a duration of time from a time that the time indicator hand is initially temporarily suspended to a time that temporary suspension of the time indicator hand is released, to provide an indication of a position where the time indicator hand would be if it had not been temporarily suspended;

a release unit that releases temporary suspension of the time indicator hand after the predetermined amount of time passes; and a time-indicator-hand driving unit that rapidly drives the time indicator hand to the position where the time indicator hand would be if its movement had not been temporarily suspended, based on the time measured by the measuring unit, after the release unit releases temporary suspension of the time indicator hand.

3. A time measurement device, comprising:

a standard time display unit that displays standard time;

a first motor operably coupled to the standard time display unit;

an elapsed time display unit, including a time indicator hand, that displays measured elapsed time;

a second motor operably coupled to the elapsed time display unit; and a controller that controls the standard time display unit, the first motor, the elapsed time display unit and the second motor;

wherein the controller is adapted to temporarily suspend movement of the time indicator hand, during measurement of elapsed time, such that the controller automatically releases temporary suspension of the time indicator hand after a predetermined amount of time passes from the time that movement of the time indicator hand is initially temporarily suspended, and actuates the second motor to rapidly drive the time indicator hand to a position indicating the elapsed time; and wherein the controller comprises a counter that counts up during the time that the movement of the time indicator hand is temporarily suspended and counts down during the time that the time indicator hand is rapidly driven after temporary suspension of the time indicator hand is released, and wherein the second motor stops rapidly driving the time indicator hand when the counter reaches zero.

4. A time measurement device according to claim 3, wherein a subsequent temporary suspension of movement of the time indicator hand is inhibited from a time when temporary suspension of the time indicator hand is automatically released to a time when the time indicator hand has been driven to the position indicating the elapsed time.

5. A time measurement device according to claim 3, wherein the controller comprises a first counter that counts elapsed time, and a second counter that counts a present position of the time indicator hand, wherein the controller controls the first counter to count up during measurement of elapsed time, and when temporary suspension of the time indicator hand is released, controls rapid driving of the time indicator hand to a position where the time indicator hand would be if it had not been temporarily suspended, controls the second counter to count up during the time that the time indicator hand is rapidly driven, and stops the rapid driving of the time indicator hand when the count of the second counter coincides with the count of the first counter.

6. A time measurement device according to claim 1, further comprising a single motor that drives the time indicator hand indicating the elapsed time.

7. A time measurement device according to claim 1, further comprising a generator for generating power.

8. A method for measuring elapsed time using a time measurement device that includes a standard time measuring unit and an elapsed time measuring unit having a time indicator hand, comprising the steps of:

(a) temporarily suspending movement of the time indicator hand during measurement of elapsed time;

(b) automatically releasing temporary suspension of the time indicator hand after a predetermined amount of time passes from the time that the time indicator hand was initially temporarily suspended;

(c) rapidly driving the time indicator hand to a position indicating the elapsed time after temporary suspension of the time indicator hand is automatically released;

(d) determining a position where the time indicator hand would be if its movement had not been temporarily suspended;

(e) determining a temporarily suspended position of the time indicator hand; and (f) comparing the position of the time indicator hand determined in step (d) and the position of the time indicator hand determined in step (e);

wherein step (c) is carried out based on the comparison result generated in step (f).

9. A method according to claim 8, further comprising the steps of:

(d) measuring a duration of time from a time that the time indicator hand is initially temporarily suspended to a time that temporary suspension of the time indicator hand is released, to provide an indication of a position where the time indicator hand would be if it had not been temporarily suspended; and (e) measuring the predetermined amount of time during which the time indicator hand is temporarily suspended;

wherein step (c) is carried out based on the time measured in step (d).

10. A method for measuring elapsed time, comprising the steps of:

(a) displaying standard time;

(b) displaying measured elapsed time using a time indicator hand;

(c) temporarily suspending movement of the time indicator hand during measurement of elapsed time;

(d) automatically releasing temporary suspension of the time indicator hand after a predetermined amount of time passes from the time that the time indicator hand was initially temporarily suspended;

(e) rapidly driving the time indicator hand to a position indicating the elapsed time after temporary suspension of the time indicator hand is automatically released;

(f) counting up during the time that the movement of the time indicator hand is temporarily suspended; and (g) counting down during the time that the time indicator hand is rapidly driven after temporary suspension of the time indicator hand is released;

wherein the rapid driving of the watch hand in step (e) is stopped when the count in step (g) reaches zero.

11. A method according to claim 10, further comprising the steps of:

(f) counting the time during which movement of the time indicator hand is temporarily suspended; and (g) counting the time during which the time indicator hand is rapidly driven to the position indicating the elapsed time;

wherein the rapid driving of the time indicator hand in step (e) is stopped when the counted time in step (g) coincides with the counted time in step (f).

12. A time measurement device, comprising:

means for measuring standard time;

means for measuring elapsed time including means for indicating elapsed time; and means, operably coupled to the elapsed time measuring means, for temporarily suspending movement of the elapsed time indicating means during measurement of elapsed time, for automatically releasing temporary suspension of the elapsed time indicating means after a predetermined amount of time passes from the time that the elapsed time indicating means was initially temporarily suspended, and for rapidly driving the elapsed time indicating means to a position indicating the elapsed time;

the elapsed time measuring means further comprising first measuring means for determining a position where the elapsed time indicating means would be if its movement had not been temporarily suspended;

second measuring means for determining a temporarily suspended position of the elapsed time indicating means;

means for releasing temporary suspension of the elapsed time indicating means after the predetermined amount of time;

means for comparing the position of the elapsed time indicating means determined by the first measuring means and the position of the elapsed time indicating means determined by the second measuring means; and means for rapidly driving the elapsed time indicating means based on the comparison result generated by the comparing means, when the releasing means releases temporary suspension of the elapsed time indicating means.

13. A time measurement device according to claim 12, wherein the elapsed time measuring means comprises means for measuring a duration of time from a time that the elapsed time indicating means is initially temporarily suspended to a time that temporary suspension of the elapsed time indicating means is released, to provide an indication of a position where the elapsed time indicating means would be if it had not been temporarily suspended;

means for releasing temporary suspension of the elapsed time indicating means after the predetermined amount of time passes; and means for rapidly driving the elapsed time indicating means to the position where the elapsed time indicating means would be if its movement had not been temporarily suspended, based on the time measured by the measuring means, after the releasing means releases temporary suspension of the elapsed time indicating means.

14. A time measurement device, comprising:

means for displaying standard time;

first means, operably coupled to the standard time displaying means, for driving the standard time displaying means;

means, including an elapsed time indicating means, for displaying measured elapsed time;

second means, operably coupled to the elapsed time indicating means, for driving the measured elapsed time displaying means; and means for controlling the standard time displaying means, the first and second driving means, and the measured elapsed time displaying means;

wherein, during the time that movement of the elapsed time indicating means is temporarily suspended during measurement of the elapsed time, the controlling means automatically releases temporary suspension of the elapsed time indicating means after a predetermined amount of time passes from the time that movement of the elapsed time indicating means was initially temporarily suspended, and actuates the second driving means to rapidly drive the elapsed time indicating means to a position indicating the elapsed time; and wherein the controlling means comprises means for counting up during the time that the movement of the elapsed time indicating means is temporarily suspended and for counting down during the time that the elapsed time indicating means is rapidly driven after temporary suspension of the elapsed time indicating means is released, and wherein the second driving means stops rapidly driving the elapsed time indicating means when the counting means reaches zero.

15. A time measurement device according to claim 14, wherein a subsequent temporary suspension of movement of the elapsed time indicating means is inhibited from a time when temporary suspension of the elapsed time indicating means is automatically released to a time when the elapsed time indicating means has been driven to the position indicating the elapsed time.

16. A time measurement device according to claim 14, wherein the controlling means comprises first counting means for counting elapsed time, and second counting means for counting elapsed time during the time that the time indicator hand moves, wherein the controlling means controls the first counting means to count up during measurement of elapsed time, and when temporary suspension of the elapsed time indicating means is released, controls rapid driving of the elapsed time indicating means to a position where it would be if it had not been temporarily suspended, controls the second counting means to count up during the time that the elapsed time indicating means is rapidly driven, and stops the rapid driving of the elapsed time indicating means when the count of the second counting means coincides with the count of the first counting means.

17. A time measurement device according to claim 12, further comprising single means for driving the elapsed time indicating means indicating the elapsed time.

18. A time measurement device according to claim 12, further comprising means for generating power.

* * * * *